US010392961B2

(12) United States Patent
Hu et al.

(10) Patent No.: US 10,392,961 B2
(45) Date of Patent: Aug. 27, 2019

(54) NOZZLE BLADE DESIGN FOR A VARIABLE NOZZLE TURBINE

(71) Applicant: Ford Global Technologies, LLC, Dearborn, MI (US)

(72) Inventors: Leon Hu, Dearborn, MI (US); Jianwen James Yi, West Bloomfiled, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 293 days.

(21) Appl. No.: 15/599,329

(22) Filed: May 18, 2017

(65) Prior Publication Data

US 2018/0334920 A1 Nov. 22, 2018

(51) Int. Cl.

| | |
|---|---|
| ***F01B 25/02*** | (2006.01) |
| ***F01D 17/16*** | (2006.01) |
| ***F01D 5/04*** | (2006.01) |
| ***F01D 9/04*** | (2006.01) |

(52) U.S. Cl.

CPC ..... *F01D 17/16* (2013.01); *F01D 5/04* (2013.01); *F01D 9/041* (2013.01); *F05D 2220/40* (2013.01); *F05D 2240/128* (2013.01); *F05D 2240/80* (2013.01)

(58) Field of Classification Search

CPC ..... F01D 17/00; F01D 17/141; F01D 17/143; F01D 17/165; F01D 17/14

USPC ..... 415/146, 148, 159, 160, 164, 165

See application file for complete search history.

(56) References Cited

U.S. PATENT DOCUMENTS

| | | | | |
|---|---|---|---|---|
| 5,181,678 | A * | 1/1993 | Widnall | B64C 3/48 244/219 |
| 5,292,088 | A * | 3/1994 | Lemont | B63H 5/14 244/65 |
| 6,461,105 | B1 | 10/2002 | Nicolson | |
| 7,255,530 | B2 | 8/2007 | Vogiatzis et al. | |
| 8,485,476 | B2 * | 7/2013 | Zha | B64C 21/025 244/208 |
| 9,188,019 | B2 | 11/2015 | Groves | |
| 2006/0010871 | A1 * | 1/2006 | Frechette | B82Y 15/00 60/670 |
| 2015/0152741 | A1 | 6/2015 | Vemula et al. | |
| 2016/0146100 | A1 | 5/2016 | Sun et al. | |

FOREIGN PATENT DOCUMENTS

| | | | |
|---|---|---|---|
| WO | 0111197 | A1 | 2/2001 |
| WO | 2006053579 | A1 | 5/2006 |

* cited by examiner

*Primary Examiner* — John Kwon

(74) *Attorney, Agent, or Firm* — Julia Voutyras; McCoy Russell LLP

(57) ABSTRACT

Systems are provided for a nozzle blade for a variable nozzle turbine of a turbocharged engine. In one example, a nozzle blade for a turbine nozzle of a variable geometry turbine may include: a cambered outer surface that curves from an inlet end to an outlet end of the nozzle blade, relative to a chord of the nozzle blade, the chord having a chord length defined from the inlet end to the outlet end, the nozzle blade having an aspect ratio in a range of 1.54 to 2.95, a thickness that is greatest in a range of 47 to 61% of the chord length, and a camber line angle change ratio in a range of 0.94 to 1.16 from the inlet end to the outlet end of the nozzle blade.

20 Claims, 13 Drawing Sheets

800

900

1022

| Nozzle Vane Height | Rotor Inlet Radius | Ratio of nozzle vane height to rotor inlet |
|---|---|---|
| 0.007 | 0.03 | 0.233 |
| 0.007 | 0.035 | 0.200 |
| 0.007 | 0.04 | 0.175 |
| 0.011 | 0.03 | 0.367 |
| 0.011 | 0.035 | 0.314 |
| 0.011 | 0.04 | 0.275 |

FIG. 10B

NOZZLE BLADE DESIGN FOR A VARIABLE NOZZLE TURBINE

FIELD

The present description relates generally to methods and systems for a nozzle blade for a variable nozzle turbine of a turbocharged engine.

BACKGROUND/SUMMARY

A turbocharger may be provided in an engine to improve engine torque or power output density. The turbocharger may include an exhaust driven turbine coupled to a compressor via a drive shaft. The compressor may be fluidly coupled to an air intake manifold in the engine. Exhaust flow from one or more engine cylinders may be directed to a wheel in the turbine causing the turbine to rotate about a fixed axis. The rotational motion of the turbine drives the compressor which compresses air into the air intake manifold to improve boost pressure based on engine operating conditions. A variable nozzle turbine may be used in the turbocharger to control engine boost pressure by varying exhaust flow conditions at a turbine nozzle. In this case, the geometry of the variable nozzle turbine may be varied by adjusting a degree of opening of blades of the turbine nozzle to accommodate a wide range of exhaust flow conditions depending on engine speed and load. For example, operating the turbine at a high efficiency with a low turbine expansion ratio may improve engine fuel economy. In this way, the variable nozzle turbine may improve turbine transient response and engine fuel economy.

The variable nozzle turbine may be susceptible to high cycle fatigue, especially under engine exhaust braking conditions. When operating in an engine exhaust braking mode, a high expansion ratio inside the turbine may generate a strong shock wave between the turbine nozzle and wheel. As a result, a strong excitation may propagate to the turbine wheel due to the shock wave, which may lead to high cycle fatigue failure in the turbine.

To improve turbine efficiency, each nozzle blade of the variable nozzle turbine may be optimized for subsonic or transonic flow conditions. Further, shock conditions may be minimized when each nozzle blade is designed to support transonic flow conditions. However, designing nozzle blades to adapt to both the subsonic and transonic flow conditions to achieve high efficiency and weak shock wave, may be a challenge.

A nozzle vane design for a variable vane assembly is disclosed by Groves in U.S. Pat. No. 9,188,019. Therein, the variable vane assembly includes an annular nozzle ring having a plurality of vanes connected to an actuator ring, and an insert having a tubular portion and a nozzle portion. The tubular portion may be accommodated in a bore in a turbine housing while the nozzle portion extends out radially from one end of the tubular portion and may be axially spaced from the nozzle ring.

However, the inventors herein have recognized potential issues with such a system. For example, the design of the vanes of the vane assembly may lead to an increase in exhaust flow near end walls of the turbine, and a reduction in flow area in a throat formed between each pair of vanes. In this case, total pressure losses in the vane assembly may increase due to an increase in end wall or turbine wheel losses. An increase in pressure losses in the system may adversely affect turbine efficiency and performance.

In one example, the issues described above may be addressed by a nozzle blade for a turbine nozzle of a variable geometry turbine, comprising: a cambered outer surface that curves from an inlet end to an outlet end of the nozzle blade, relative to a chord of the nozzle blade, the chord having a chord length defined from the inlet end to the outlet end, the nozzle blade having an aspect ratio in a range of 1.54 to 2.56, a thickness that is greatest in a range of 47 to 61% of the chord length. In this way, each nozzle blade on the turbine nozzle may be designed to direct exhaust flow into the turbine while reducing end wall and turbine losses.

As one example, nozzle blades having a specified combination of aspect ratio, blade thickness and camber line angle change ratio may be provided on a turbine nozzle of a variable nozzle turbine, thereby allowing the turbine to accommodate a range of exhaust flow conditions depending on engine operating conditions, such as engine speed and load.

The approach described here may confer several advantages. For example, each nozzle blade of the turbine nozzle may be adjustable between an open and a closed position, where a degree of blade opening may be adjustable to accommodate a wide range of exhaust flow conditions based on engine operating conditions. In addition, the nozzle blades of the turbine nozzle may be adapted to have a wide range of aspect ratios, blade thickness and camber line angle change ratios. By providing a turbine nozzle having nozzle blades which each have a combination of an aspect ratio in a specified range, a blade thickness in a specified range, and a camber line angle change ratio in a specified range, turbine efficiency may be improved while reducing high cycle fatigue of the turbine components.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 10B shows an example graphic output of a nozzle blade height, a rotor inlet radius of a variable nozzle turbine and ratio of nozzle blade height to rotor inlet radius.

FIGS. 2A-7C and 10A are shown approximately to scale, although other relative dimensions may be used, if desired.

DETAILED DESCRIPTION

Figure 1:
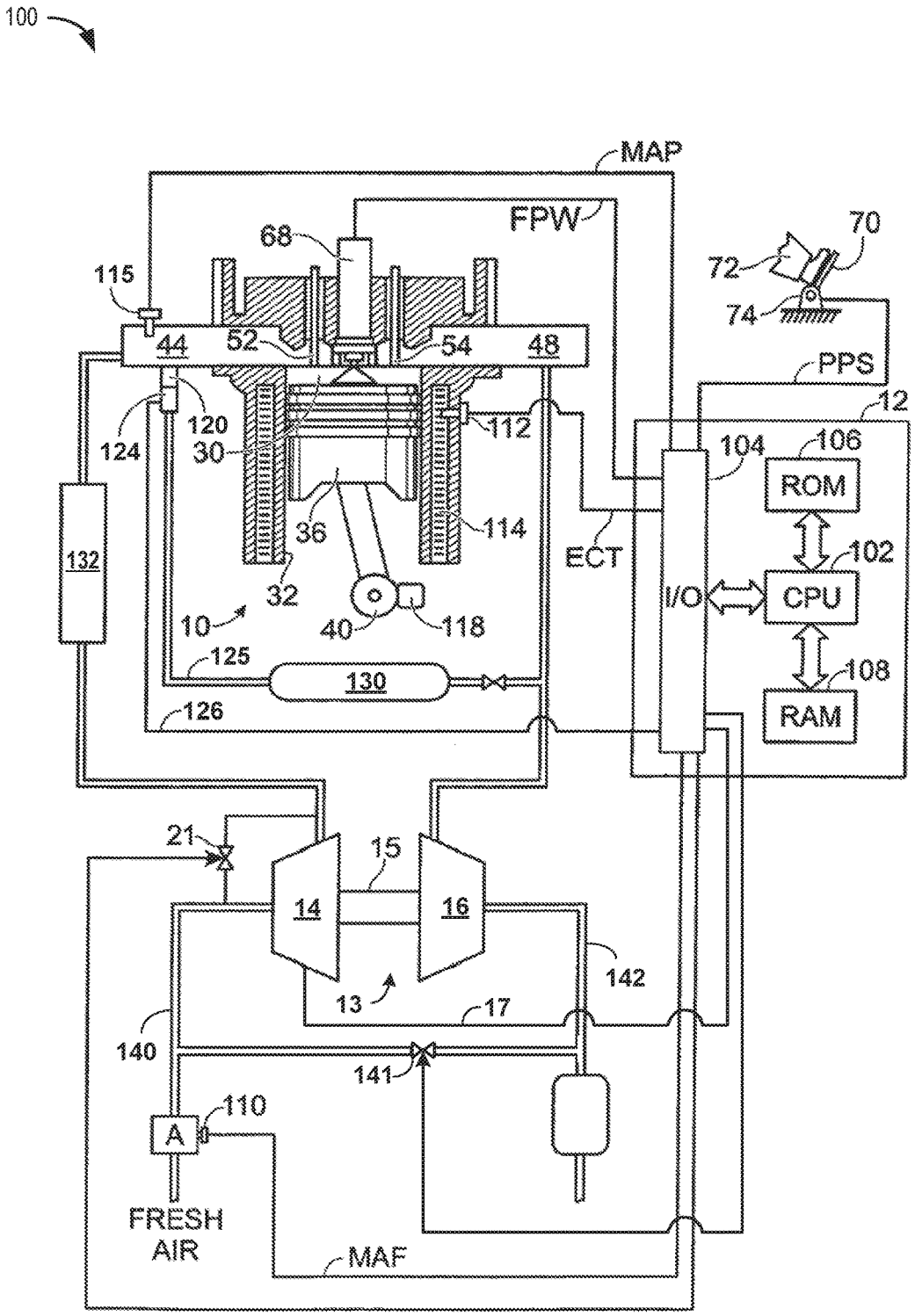
FIG. 1 shows a schematic view of an engine with a turbocharger.
Figure 2A:
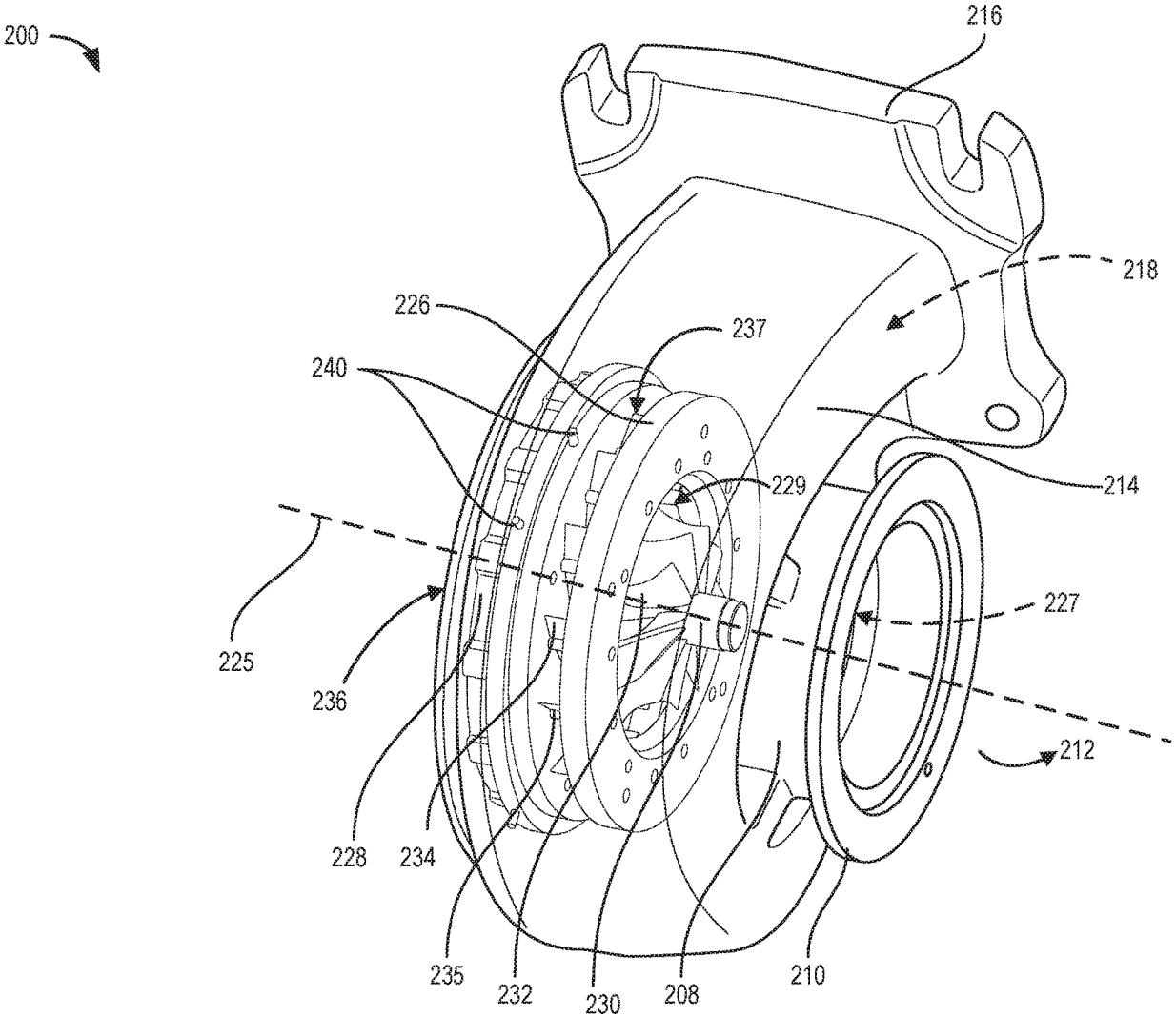
FIG. 2A shows a first view of a variable nozzle turbine of an engine.
Figure 2B:
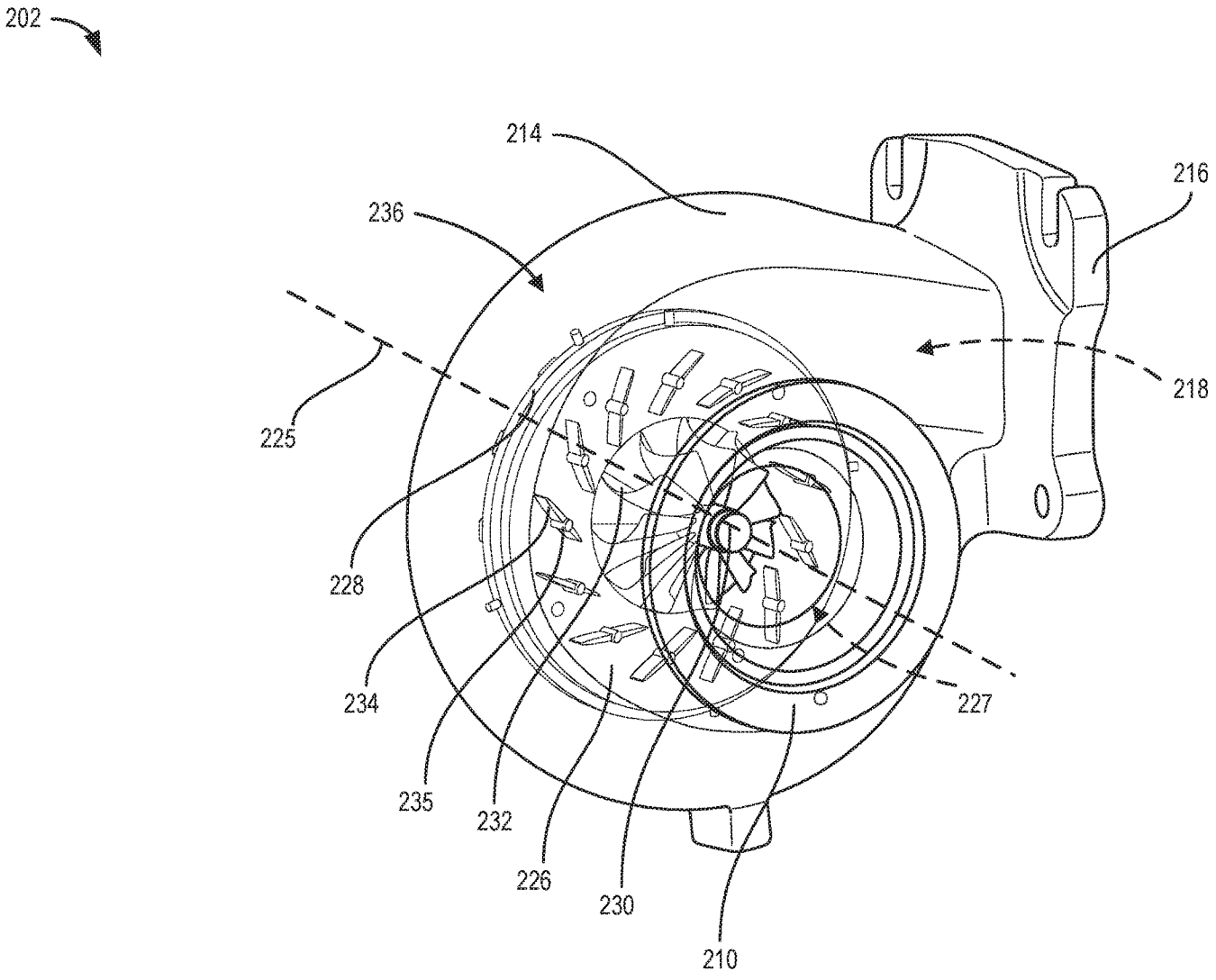
FIG. 2B shows a second view of the variable nozzle turbine of the engine.

The following description relates to systems and methods for a nozzle blade design for a variable nozzle turbine of a turbocharged engine. The variable nozzle turbine may be an exhaust driven turbine which produces power to operate a compressor coupled to the turbine via a shaft, as shown in FIG. 1. In this way, the exhaust-driven turbine supplies energy to the compressor to boost the pressure and air flow into the engine. The boost pressure may be controlled by the rotational speed of the variable turbine which is at least partially controlled by the flow of exhaust gas through turbine. FIGS. 2A-2B show a first and a second three dimensional view, respectively of a variable nozzle turbine, similar to the turbine shown in FIG. 1. The variable nozzle turbine may include an exhaust passage connected to exhaust outlets on engine cylinders, and a bypass passage that directs exhaust gas to an exhaust gas recovery system. As shown in FIG. 2A, a turbine wheel having a plurality of turbine blades may be positioned in an opening between a first nozzle plate and a second nozzle plate mounted within a housing of the variable nozzle turbine.

A plurality of nozzle blades may be positioned in a turbine inlet formed between the first and second nozzle plates. Each nozzle blade may be mounted to the second nozzle plate via a rod (not shown) that secures the blade to the nozzle plate while allowing for rotational motion of the blade. For example, the nozzle blades may be pivotally mounted to the second nozzle plate, such that the blades may be adjustable between an open position (where the blades are spaced apart) to a closed position, where the blades are spaced close together, with a trailing edge of a leading nozzle blade positioned adjacent to a leading edge of a following nozzle blade. The position of nozzle blades may be adjusted via an actuator (not shown) coupled to each rod of each blade mounted to the second nozzle plate.

Figure 2C:
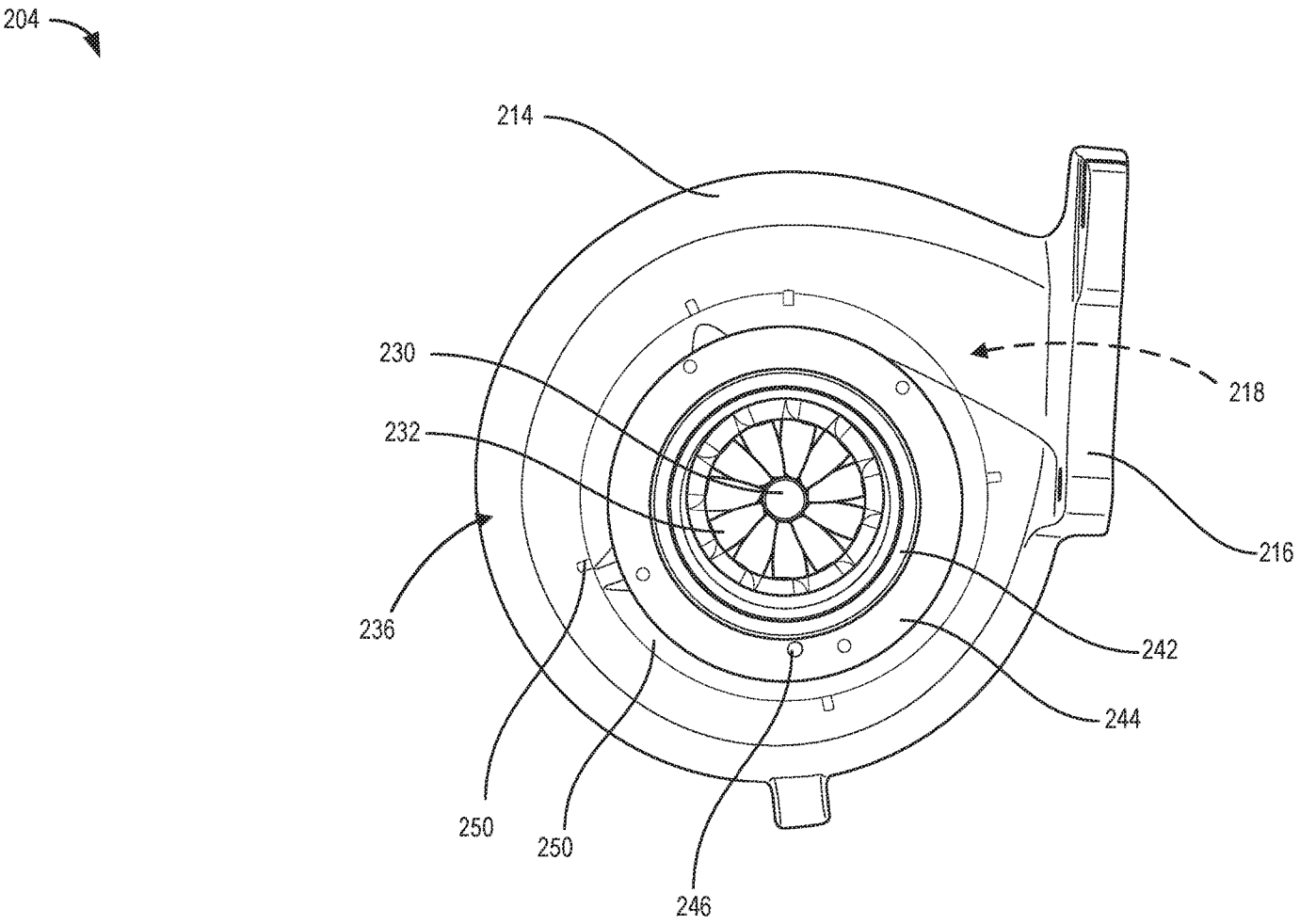
FIG. 2C shows a third view of the variable nozzle turbine of the engine.

FIG. 2C, shows a cross sectional view across the turbine passage and exhaust manifold of the variable nozzle turbine. The turbine wheel is mounted within the turbine passage, with a turbine inlet provided between the first and second nozzle plates. The exhaust manifold includes an enlarged portion that directs exhaust flow into the turbine inlet, as shown in FIG. 2C.

Figure 3B:
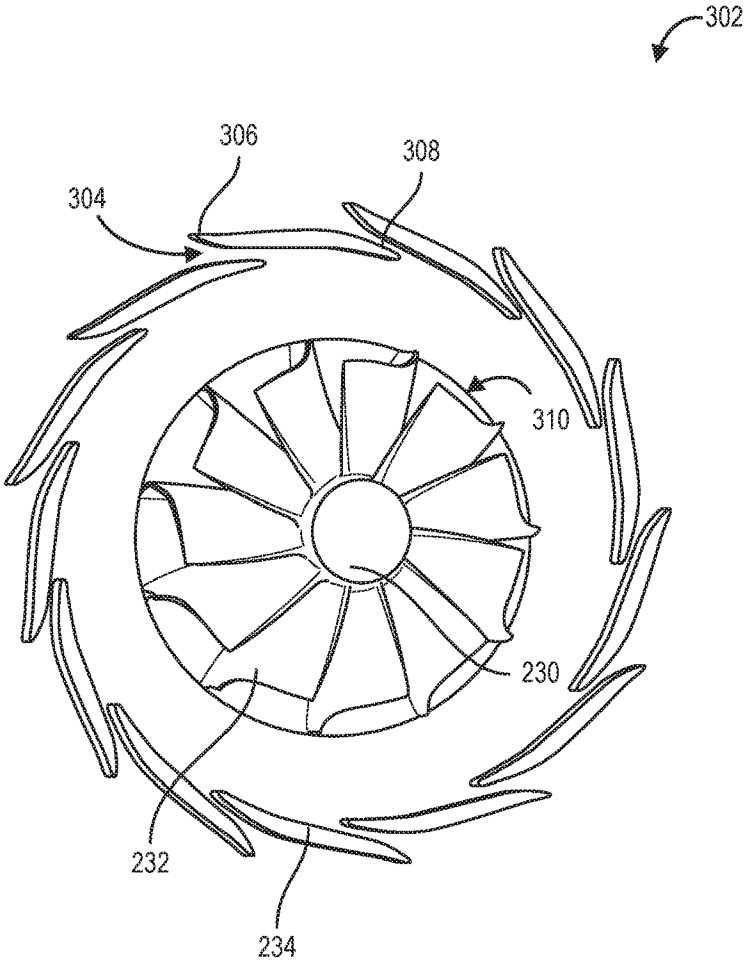
FIG. 3B shows a second schematic view of the plurality of nozzle blades adjusted to a closed position.
Figure 3A:
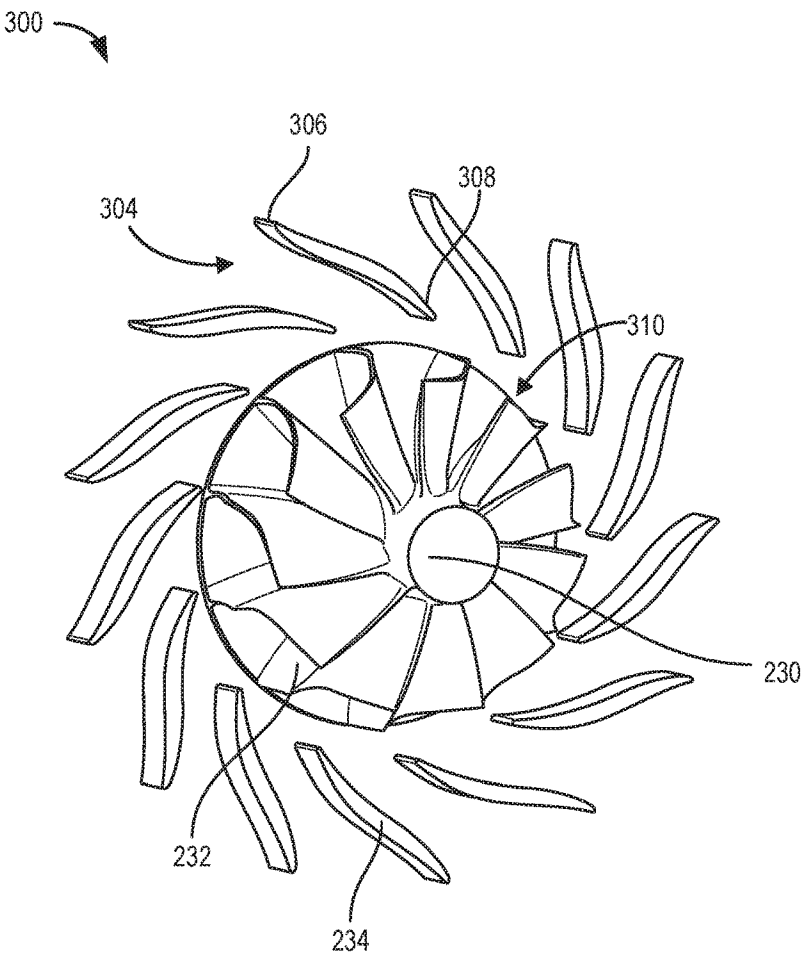
FIG. 3A shows a first schematic view of a plurality of nozzle blades adjusted to an open position.

FIGS. 3A-3B, show a first schematic view of the nozzle blades adjusted to an open position and a second schematic view of nozzle blades adjusted to a closed position, respectively. Exhaust gas released from one or more engine cylinders may be diverted to the variable nozzle turbine, where the exhaust gas drives the turbine wheel during engine operation. In this case, the nozzle blades on the turbine nozzle may be adjusted between the open and closed position to control exhaust flow into the turbine based on engine operating conditions such as engine load and speed. For example, when the nozzle blades on the nozzle plate are adjusted to the open position, less energy may be imparted to the turbine to reduce compressor boost. In one example, during moderate to high engine speed and load, the nozzle blades on the nozzle plate may be adjusted to a fully open position to minimize or reduce turbocharger over-speed while maintaining suitable or adequate boost pressure. In another example, the nozzle blades may be adjusted to the closed position to direct exhaust flow tangentially to the blades, and increase a pressure gradient across the turbine. In this case, exhaust flow imparts more energy to the turbine which in turn may increase compressor boost. The exhaust gas spins the turbine blades to produce rotational power which is transmitted to the compressor to increase engine boost pressure. In this way, the position of the nozzle blade may be adjusted to vary geometry of the variable nozzle turbine to control exhaust flow into the turbine depending on the engine operating conditions.

Figure 4B:
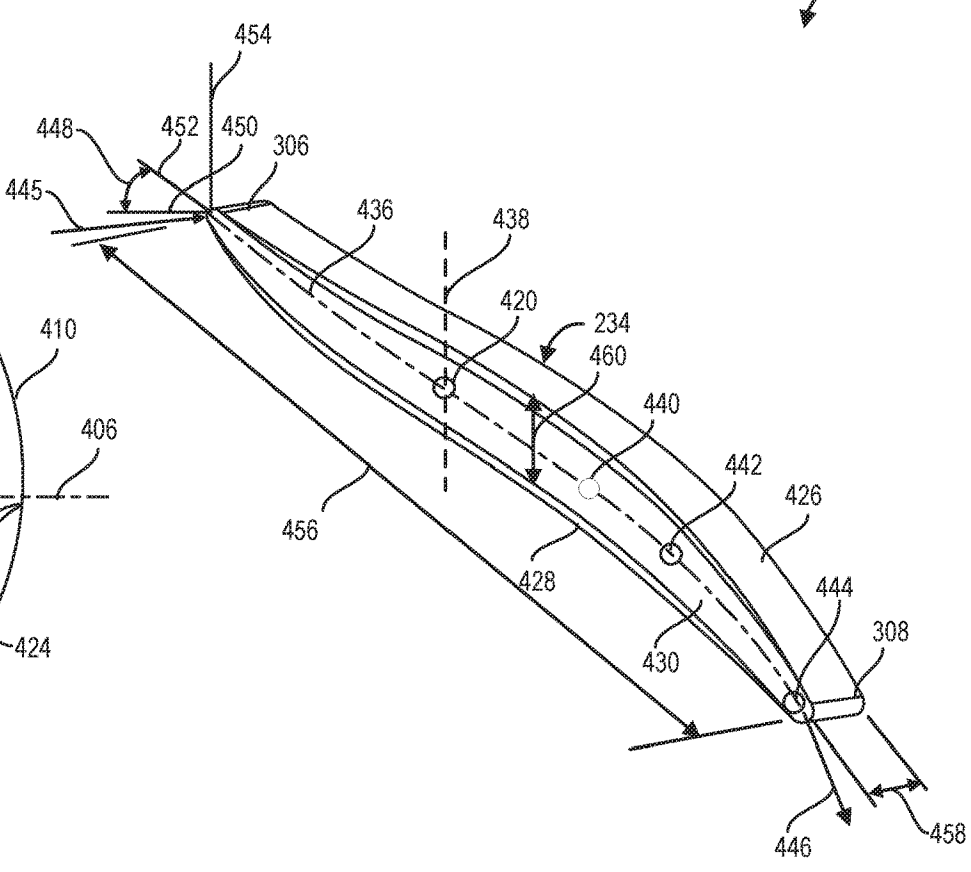
FIG. 4B shows a three dimensional view of the nozzle blade having a leading and a trailing edge.
Figure 4A:
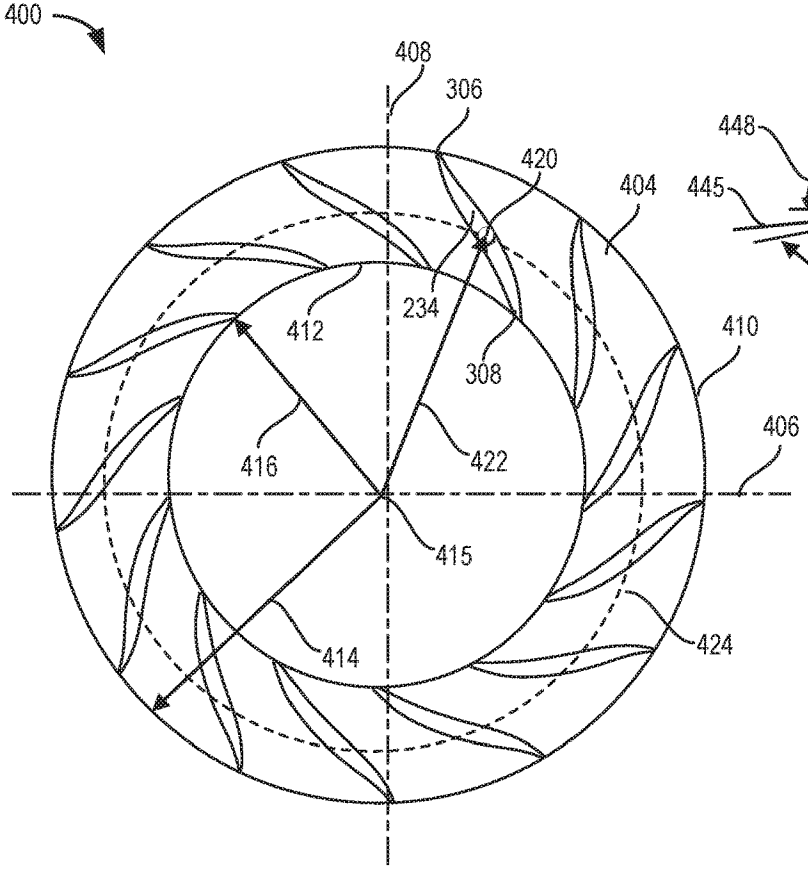
FIG. 4A shows a turbine nozzle with a nozzle plate having a plurality of nozzle blades.

Each nozzle blade may be pivotally mounted to the nozzle plate via a rod extended into the plate, as shown in FIG. 4A. As an example, each nozzle blade may be mounted to the nozzle plate such that a leading edge of the blade is positioned adjacent to the outer edge of the plate, and a trailing edge of the blade is positioned adjacent to the inner edge of the plate. The leading edge of the nozzle blade is located at an inlet end of the blade, and the trailing edge is located at an outlet end of the blade, downstream from the inlet end. Exhaust flow may be directed at the inlet end of the nozzle blade, and then along an inner face of the blade before exiting at the blade outlet. FIG. 4B, shows a three dimensional view of the nozzle blade. As an example, the nozzle blade may include an outer face, an inner face and a plurality of side faces. A camber line drawn through a mid-section of each nozzle blade, connects the leading edge to the trailing edge of the blade. The outer surface of each nozzle blade may be a curved surface having a concave portion and a convex portion. As an example, the concave portion may be adjacent to the leading edge and the convex portion may be formed between a mid-section of the blade and trailing edge. In one example, the curvature of the each nozzle blade is optimized to provide optimal flow at both subsonic and transonic flow conditions. During turbine normal operation conditions, especially at a small nozzle open condition, the nozzle blades having the geometries disclosed herein may reduce flow loss inside the on the turbine nozzle, thereby improving turbine stage efficiency for various engine drive cycles. At an engine exhaust braking condition, the optimized curvature of the nozzle blades controls the expansion process within the turbine nozzle, thereby reducing occurrence of shock wave within the turbocharger while minimizing turbine high cycle fatigue.

Figure 5B:
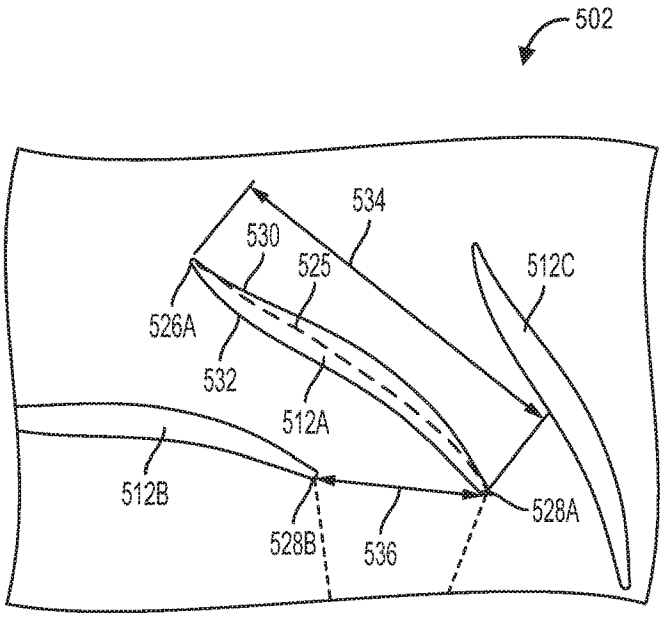
FIG. 5B shows a cross sectional view of a plurality of first nozzle blades.
Figure 5A:
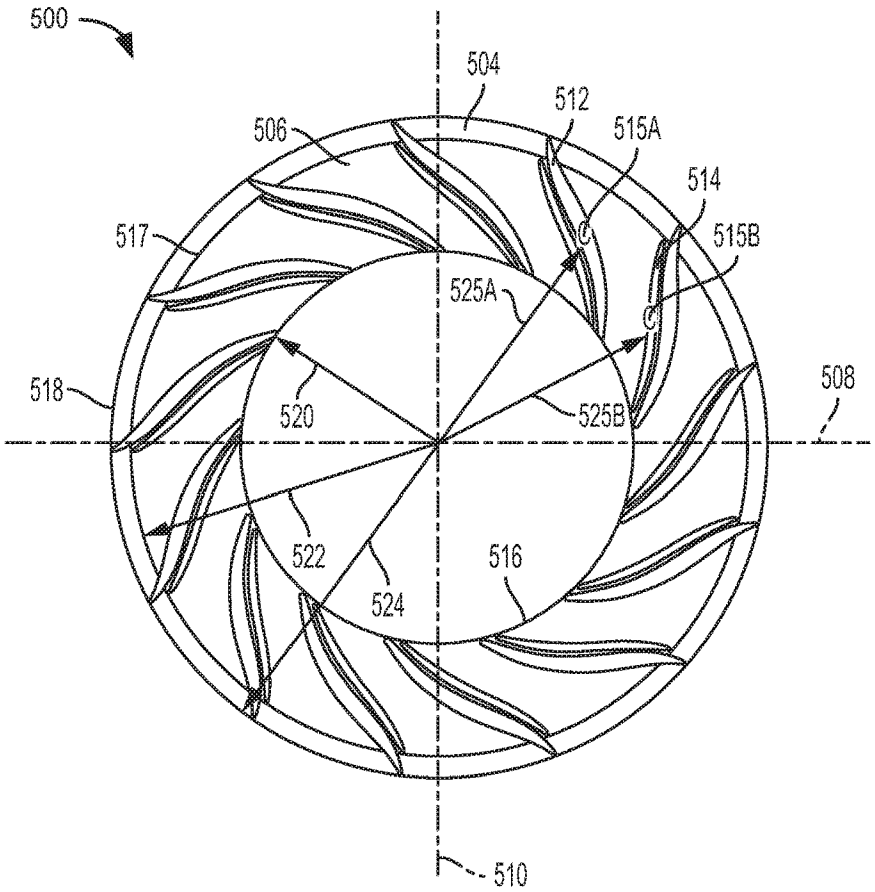
FIG. 5A shows a schematic view of a first nozzle plate having a plurality of first nozzle blades and a second nozzle plate having a plurality of second nozzle blades.
Figure 6B:
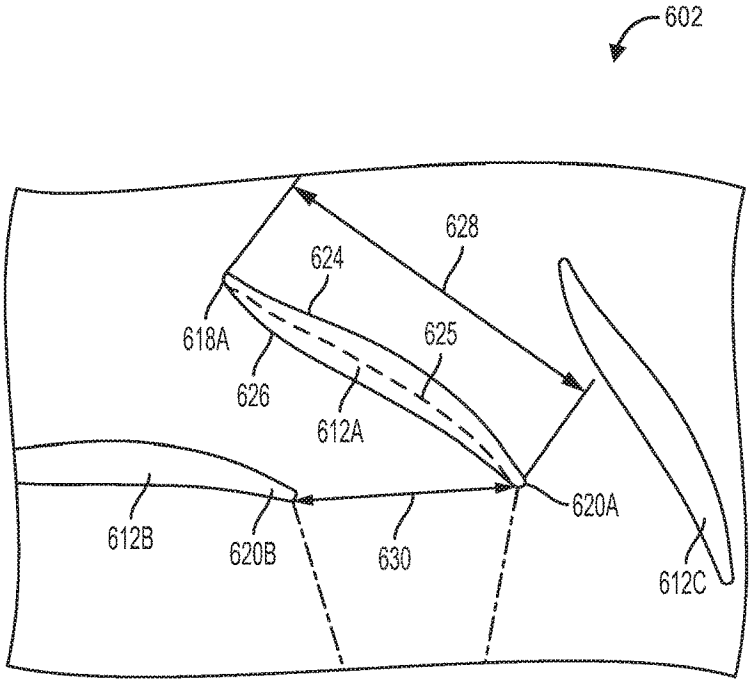
FIG. 6B shows a cross sectional view of the plurality of the third nozzle blades.

Nozzle blades of different dimensions may be provided on different nozzle plates of a variable geometry turbine, as shown in FIGS. 5A-6B. A longer nozzle blade having a longer chord length compared to a base blade design may be mounted to the nozzle plate as shown in FIG. 5A. The longer nozzle blade may have a first aspect ratio, as disclosed with reference to FIG. 5B. Conversely, a shorter nozzle blade having a shorter chord length compared to the base blade design may be mounted to the nozzle plate as shown in FIG. 6A. The shorter nozzle blade may have a second aspect ratio, as disclosed with reference to FIG. 6B. The shorter and longer nozzle blade designs may have a wide range of aspect ratios, blade thickness and camber line angle change ratios. In this way, nozzle blades having a combination of suitable aspect ratios, blade thickness and camber line angle change ratio may be provided on the variable nozzle turbine to improve turbine efficiency and reduce high cycle fatigue of turbine components. As shown in FIGS. 7A-7C, a number of nozzle blades provided on the nozzle plate of the variable nozzle turbine may be varied based on desired turbine performance. Increasing the number of nozzle blades on the nozzle plate may increase the aspect ratio. In contrast, decreasing the number of nozzle blades on the nozzle plate may decrease the aspect ratio. The number of nozzle blades on a turbine nozzle may be varied between 11 and 14 to match different turbine wheel designs, for example. In another example, the number of nozzle blades on the turbine nozzle may be selected in order to reduce resonance vibration within the turbine wheels.

Figure 8:
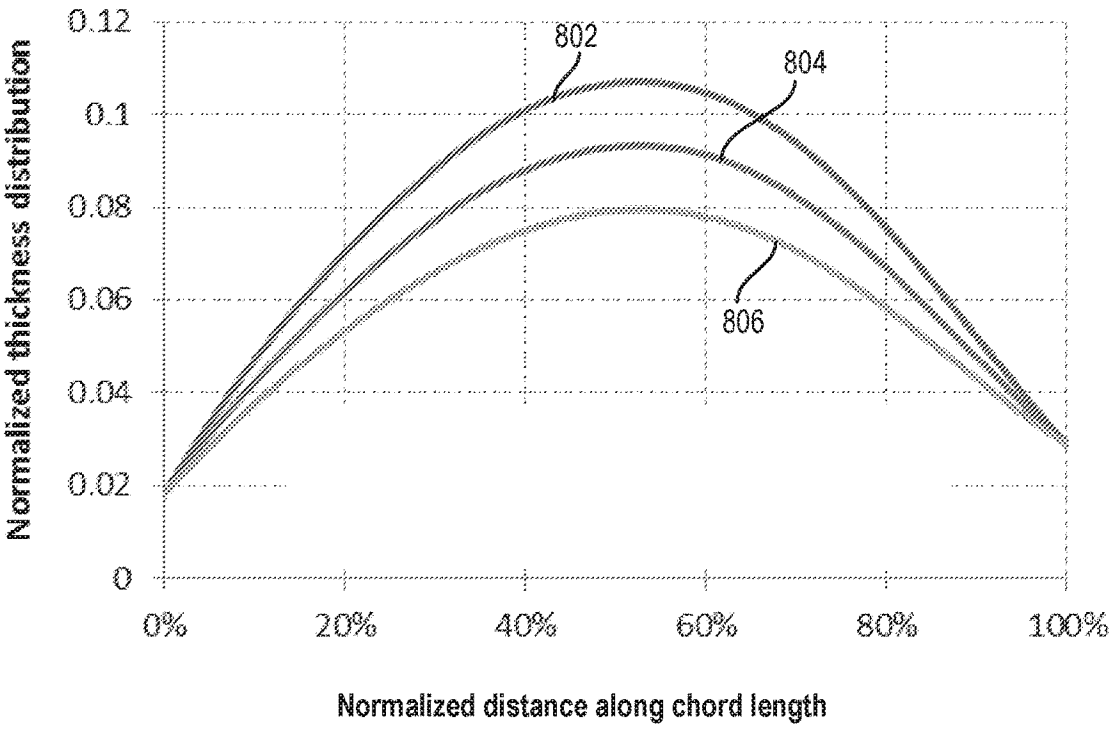
FIG. 8 shows an example graphic output of normalized thickness for a thick, base and thin nozzle blade designs.

FIG. 8 shows an example graphic output of normalized thickness for various blade designs. As an example, the blade designs may include a thicker nozzle blade, base nozzle blade and a thinner nozzle blade. A distribution of the normalized thickness for each blade design may vary along a normalized distance of a blade chord length. For example, a maximum thickness of the blade may be located at a mid-stream of the blade, and a minimum thickness of the blade may be located at leading and trailing edges of the blade.

Figure 9:
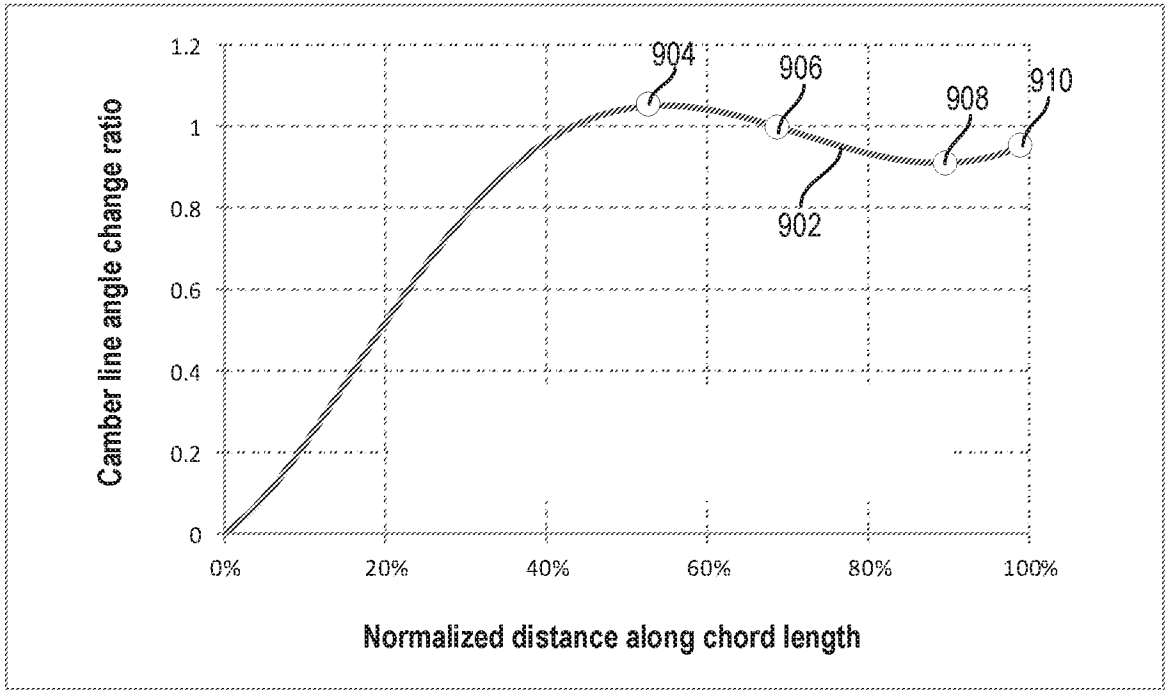
FIG. 9 shows an example graphic output of a camber line angle change ratio versus normalized distance along a chord length of a nozzle blade.

FIG. 9 shows an example graphic output of a camber line angle change ratio versus normalized distance along a chord length of a blade is disclosed. In this example, the blade may be adjusted to a large open position that allows adequate exhaust flow through blades on a nozzle plate of the variable nozzle turbine. The camber line angle change ratio is determined as a difference between a blade angle at a specific point along the camber line and a blade angle at a leading edge of the blade, the difference in the blade angle being normalized by the blade angle at the blade leading edge. The camber line angle change ratio may increase rapidly from a minimum value at a blade inlet to a maximum value at a mid-stream of the blade. For example, the maximum camber line angle change ratio may be located at 53% of the normalized distance from the blade inlet. After reaching the maximum value at the mid-stream of the blade, the camber line angle change ratio may gradually decrease with increase in normalized distance along the chord length before increasing again to a high value at the trailing edge of the blade. In this way, the camber line angle change ratio may change along the normalized distance of the blade chord length, when the blade is adjusted to the open position.

Figure 10A:
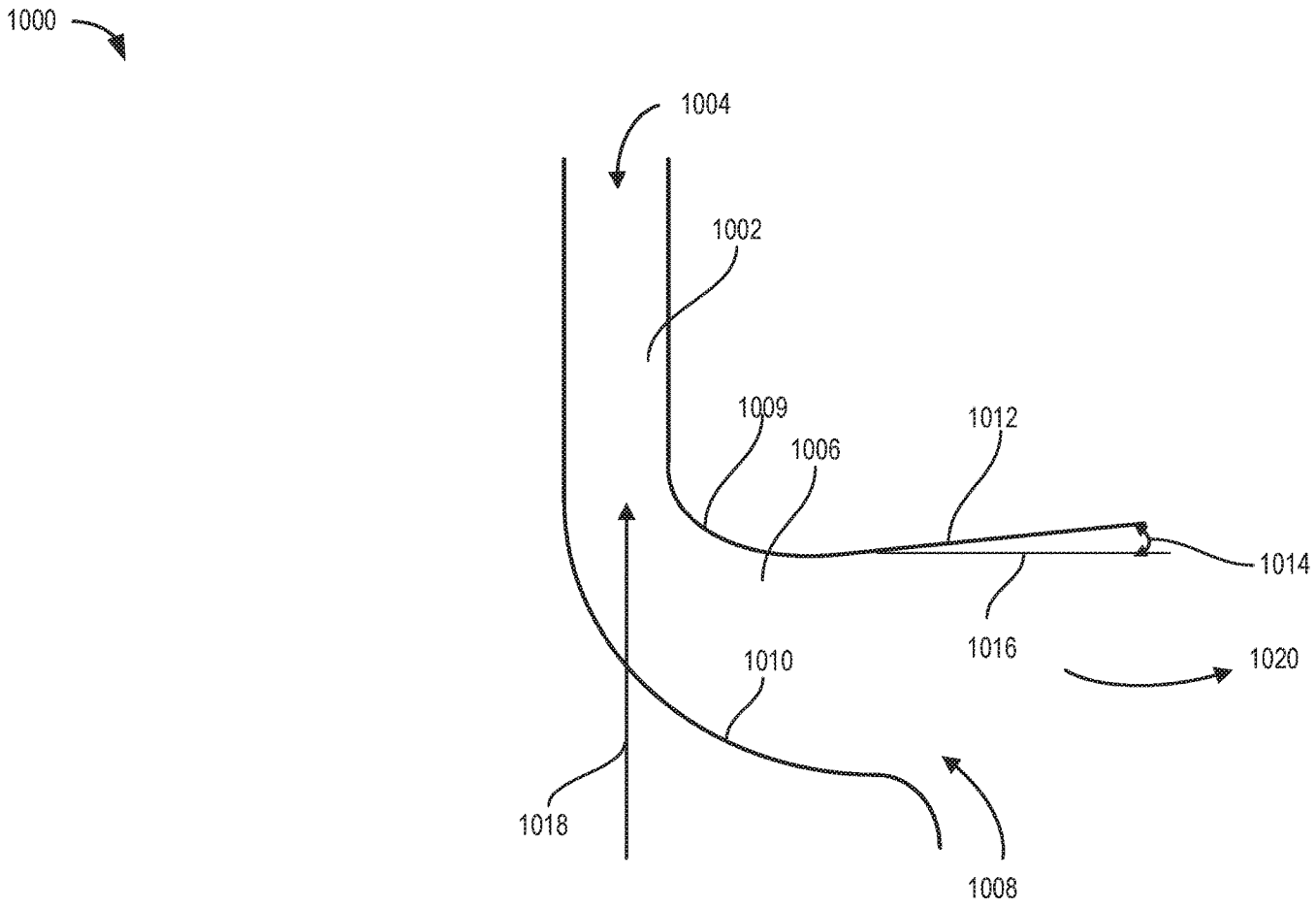
FIG. 10A shows a cross sectional view of a portion of a variable nozzle turbine.

FIG. 10A shows a cross sectional view of a portion of a variable nozzle turbine. A turbine rotor having a rotor inlet positioned upstream of a turbine chamber is depicted in FIG. 10A. The rotor inlet of the turbine may have a rotor inlet radius that may be designed to accommodate a wide range of exhaust flow conditions. FIG. 10B shows an example graphic output of a nozzle blade height, a rotor inlet radius of a variable nozzle turbine and ratio of the nozzle blade height to rotor inlet radius. The ratio of nozzle blade height to rotor inlet radius is calculated by dividing the nozzle blade height with a plurality of rotor inlet radii of the turbine. For different designs, the nozzle blade height may vary from 0.007 mm to 0.11 mm, for example. The rotor inlet radius may vary from 0.030 mm to 0.04 mm, for example. The ratio of nozzle vane height to rotor inlet may vary from 0.175 to 0.367.

Turning now to FIG. 1, a schematic view 100 of an example internal combustion engine 10 having a turbocharger is disclosed. Specifically, internal combustion engine 10 may comprise a plurality of cylinders, one cylinder of which is shown in FIG. 1. The internal combustion engine 10 may be controlled at least partially by a control system including controller 12 and by input from a vehicle operator 72 via an input device 70. In this example, input device 70 includes an accelerator pedal and a pedal position sensor 74 for generating a proportional pedal position signal PPS. Engine 10 includes combustion chamber 30 and cylinder walls 32 with piston 36 positioned therein and connected to crankshaft 40. Combustion chamber 30 communicates with intake manifold 44 and exhaust manifold 48 via respective intake valve 52 and exhaust valve 54. Intake manifold 44 is also shown having fuel injector 68 coupled thereto for delivering fuel in proportion to the pulse width of signal (FPW) from controller 12.

Controller 12 is shown in FIG. 1 as a microcomputer, including microprocessor 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 110; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 115. Engine speed signal, RPM, may be generated by controller 12 from signal PIP. Further, controller 12 may estimate a compression ratio of the engine based on measurements from a pressure transducer (not shown) positioned in the combustion chamber 30.

The controller 12 receives signals from the various sensors of FIG. 1 and employs the various actuators of FIG. 1 to adjust engine operation based on the received signals and instructions stored on a memory of the controller. Storage medium read-only memory 106 can be programmed with computer readable data representing instructions executable by processor 102 for performing the methods.

In a configuration known as high pressure EGR, exhaust gas is delivered to intake manifold 44 by EGR tube 125 communicating with exhaust manifold 48. EGR valve assembly 120 is located in EGR tube 125. Stated another way, exhaust gas travels from exhaust manifold 48 first through valve assembly 120, then to intake manifold 44. EGR valve assembly 120 can then be said to be located upstream of the intake manifold. There is also an optional EGR cooler 130 placed in EGR tube 125 to cool EGR before entering the intake manifold. Low pressure EGR may be used for recirculating exhaust gas from downstream of turbine 16 to upstream of compressor 14 via valve 141.

Pressure sensor 115 provides a measurement of manifold pressure (MAP) to controller 12. EGR valve assembly 120 has a valve position (not shown) for controlling a variable area restriction in EGR tube 125, which thereby controls EGR flow. EGR valve assembly 120 can either minimally restrict EGR flow through tube 125 or completely restrict EGR flow through tube 125, or operate to variably restrict EGR flow. Vacuum regulator 124 is coupled to EGR valve assembly 120. Vacuum regulator 124 receives actuation signal 126 from controller 12 for controlling valve position of EGR valve assembly 120. In one embodiment, EGR valve assembly is a vacuum actuated valve. However, any type of flow control valve may be used, such as, for example, an electrical solenoid powered valve or a stepper motor powered valve.

Turbocharger 13 has a turbine 16 coupled to exhaust manifold 48 and a compressor 14 coupled in the intake manifold 44 via an intercooler 132. Turbine 16 is coupled to compressor 14 via a drive shaft 15. Air at atmospheric pressure enters compressor 14 from passage 140. Exhaust gas flows from exhaust manifold 48, through turbine 16, and exits passage 142. In this manner, the exhaust-driven turbine supplies energy to the compressor to boost the pressure and flow of air into the engine. The boost pressure may be controlled by the rotational speed of turbine 16 which is at least partially controlled by the flow of exhaust gas through turbine 16.

Referring to FIGS. 2A-2C, a first view of a variable nozzle turbine 200 (similar to turbine 16 shown in FIG. 1), a second view 202 of the variable nozzle turbine, and a third view 204 of the variable nozzle turbine, respectively is disclosed. The variable nozzle turbine may include a turbine volute 214 that is coupled to an exhaust manifold (such as manifold 48 shown in FIG. 1) having a turbine inlet 218. Although shown as having a single inlet (e.g., turbine inlet 218), the turbine may have a dual inlet, with a first inlet located at one end of the turbine, and a second inlet located on another end of the turbine volute. A flange 216 may couple to the exhaust manifold leading to one or more engine cylinders.

As shown in FIGS. 2A and 2B, a turbine wheel 230 having a plurality of blades 232 may be positioned along a turbine axis 225 in a main opening 227 of a flow passage 208. When mounted within the main opening 227, the turbine wheel 230 may be positioned in an aperture 229 formed in a middle portion of a first nozzle plate 226 and a second nozzle plate 228 mounted to a turbine housing 236. The second nozzle plate 228 is mounted to an inner wall of the turbine housing 236 via a plurality of dowels 238. The first nozzle plate 226 may be secured to the second nozzle plate 228 via a plurality of connectors (not shown) positioned along circumferential surfaces of both plates. When secured together, the first and second nozzle plates 226 and 228 may be spaced apart to form an inlet 237 to the turbine. The second nozzle plate may include a plurality of rods 240, formed along a circumference surface of the plate. A coupler 210 connected to the flow passage 208 has an outlet 212 that allows flow of exhaust gas leaving the turbine wheel 230 to exit. The inner wall of the turbine housing 236 may include a plurality of cylindrical rods (not shown) which connect to an actuation system used to pivot the nozzle vane blades, for example.

A plurality of blades (e.g., nozzle blades) 234 may be positioned in the inlet 237 between the first nozzle plate 226 and second nozzle plates 228. Each nozzle blade 234 may be mounted to the second nozzle plate 228 via a rod 235 that secures the nozzle blade to the nozzle plate while allowing for rotational motion of the nozzle blade. Each nozzle blade may be coupled to the second nozzle plate via a pair of cylindrical rods positioned on a first end and a second end of the nozzle blade. The pair of cylindrical rods may be installed into slots formed on each nozzle blade. A first rod on the nozzle blade may be connected to the actuation system to pivot the nozzle blade, for example. For example, the nozzle blades 234 may be pivotally mounted to the second nozzle plate, such that the nozzle blades may be adjustable between an open position (where the blades are spaced apart) and a closed position, where the nozzle blades are spaced close together, with a trailing edge of a leading blade positioned adjacent to a leading edge of a following nozzle blade. The position of nozzle blades 234 may be adjusted via an actuator (not shown) coupled to each rod of each nozzle blade mounted to the second nozzle plate 228.

As shown in the third view 204 of the variable nozzle turbine 200 in FIG. 2C, the turbine wheel 230 and turbine blades 232 may be positioned within an opening formed through a first annular ring 242 mounted to a rear portion of the turbine housing 236. The second annular ring 244 may be coupled to the rear portion of the turbine housing 236 via a plurality of fasteners 246. An outer plate 248 having a plurality of rods 250, may enclose the second annular ring 244. In this way, the first and second annular rings 242 and 244 and the outer ring 248 may be concentrically mounted to the turbine housing 236 to accommodate the turbine wheel 230 of the variable nozzle turbine 200.

Turning back to FIGS. 2A and 2B, exhaust gas released from one or more engine cylinders may be diverted to the turbine housing 236 (via the turbine inlet 218 of the turbine volute 214) to run the turbine wheel during engine operation. The nozzle blades 234 may be adjusted between the closed and open position to control exhaust flow into the turbine wheel 230 based on engine operating conditions such as engine load and speed. For example, the nozzle blades 234 may be adjusted to the closed position to direct exhaust flow tangentially to the nozzle blades, and increase a pressure gradient across the turbine. In this case, exhaust flow imparts more energy to the turbine which in turn may increase compressor boost. The exhaust gas spins the turbine blades 232 to produce rotational power which is transmitted to the compressor (e.g., compressor 14 shown in FIG. 1) via a shaft (not shown), thereby allowing the compressor to increase engine boost pressure. For example, during low engine speed/load and low exhaust flow, the blades 234 of the variable nozzle turbine 200 may be adjusted to the closed position to increase turbine power and boost pressure in the engine.

Conversely, adjusting the nozzle blades 234 to the open position directs exhaust flow radially to the turbine and decrease the pressure gradient across the turbine. In this case, less energy may be imparted to the turbine to reduce compressor boost. For example, during moderate to high engine speed/load and high exhaust flow, the nozzle blades 234 of the variable nozzle turbine may be adjusted to the open position to minimize or reduce turbocharger overspeed while maintaining suitable or adequate boost pressure. In this way, the geometry of the variable nozzle turbine may be adjusted to allow for boost pressure regulation and optimize power output while improving fuel efficiency and reducing fuel emissions. After leaving the turbine wheel 230, the exhaust flow exits the turbine housing 236 via the outlet 212.

Referring to FIGS. 3A-3B, a first schematic view 300 of the plurality of nozzle blades 234 adjusted to an open position and a second schematic view 302 of nozzle blades 234 adjusted to a closed position, respectively are disclosed. In each of the first and second schematic views 300 and 302, the nozzle blades 234 are positioned around a periphery of the turbine wheel 230 having turbine blades 232. Although not shown, a nozzle plate may be provided to receive the nozzle blades 234 positioned around the turbine wheel 230. Each nozzle blade 234 may be mounted to the nozzle plate via a rod that allows for rotational movement of the blade, thereby allowing each blade to be adjusted between a closed position and an open position.

As shown in FIG. 3A, the nozzle blades 234 are adjusted to the open position where an opening 304 in between each pair of adjacent nozzle blades 234 allows radial exhaust flow into the turbine blades 232 of the turbine wheel 230. In this case, each nozzle blade 234 may be pivoted about a mounting axis such that a leading edge 306 of each nozzle blade 234 faces away from the turbine wheel 230 and a trailing edge 308 of each nozzle blade 234 faces an outer circumferential surface 310 of the turbine wheel 230. In this example, exhaust flow enters the turbine wheel 230 at a suitable angle that allows the turbine wheel 230 to rotate about a fixed axis during engine operation. The rotational motion of the turbine wheel 230 drives a compressor (not shown) coupled to the turbine via a shaft, where the compressor allows engine boost pressure to be adjusted based on engine operating conditions. For example, when the nozzle blades 234 on the nozzle plate are adjusted to the open position, less energy may be imparted to the turbine which in turn may decrease compressor output to reduce compressor boost. In one example, during moderate to high engine speed and load, the nozzle blades 234 on the nozzle plate may be adjusted to a fully open position to minimize or reduce turbocharger over-speed while maintaining adequate engine boost pressure. In this way, a degree of opening of the nozzle blades 234 may be adjusted to accommodate a wide range of exhaust flow conditions depending on the engine operating conditions.

The nozzle blades 234 may be adjusted from the open position to a closed position, where the leading edge 306 of each nozzle blade 234 is positioned adjacent to the trailing edge 308 of a following nozzle blade, thereby reducing exhaust flow into the opening 304 between each pair of nozzle blades 234, as shown in FIG. 3B. For example, a leading edge of a first nozzle blade may be positioned adjacent to a trailing edge of a second nozzle blade to reduce exhaust flow into an opening between each of the first and second nozzle blades. In this case, the nozzle blades 234 may be adjusted to the closed position to direct exhaust flow tangentially to the nozzle blades 234. In this example, exhaust flow imparts more energy to the turbine which in turn may increase compressor output to improve engine boost pressure based on engine operating conditions. In another example, during low engine speed/load and low exhaust flow, the nozzle blades 234 may be adjusted to the closed position to increase turbine power and improve engine boost pressure. In this way, the nozzle blades 234 may be adjusted between the open and closed positions to accommodate a wide range of exhaust flow conditions to improve turbine efficiency while reducing fatigue on turbine components caused by shock flow conditions.

Referring to FIG. 4A, a turbine nozzle 400 comprising a nozzle plate 404 having the plurality of nozzle blades 234 is disclosed. The nozzle plate 404 includes an outer edge 410 and an inner edge 412. The nozzle plate 404 may further include a first axis 406 and a second axis 408.

As shown in FIG. 4A, each nozzle blade 234 may be mounted to the nozzle plate 404 via a rod extended through a slot formed at a pivot position 420 on the nozzle blade and plate. When adjusted to an open position, the leading edge 306 of each nozzle blade 234 on the nozzle plate 404 may be positioned adjacent to the outer edge 410 of the nozzle plate, and the trailing edge 308 of each nozzle blade 234 may be positioned adjacent to the inner edge 412 of the nozzle plate. The pivot position (e.g., point) 420 on each nozzle blade 234 may lie at a radial distance 422 from a center 415 of the nozzle plate. In this case, the pivot position 420 of each nozzle blade 234 may lie on an imaginary circle 424 having a radius equal to the radial distance 422. The outer edge 410 of the nozzle plate 404 may have an outer radius 414, and the inner edge 412 of the nozzle plate 404 may have an inner radius 416. As an example, the outer radius 414 of the nozzle plate 404 may range from 50 mm to 70 mm and the inner radius 416 of the nozzle plate 404 may range from 30 mm to 45 mm.

Turning now to FIG. 4B, a three dimensional view 402 of the nozzle blade 234 in the open position is disclosed. The nozzle blade 234 may include an outer surface 426, an inner surface 428 and side surfaces 430. When mounted to the nozzle plate, the inner surface 428 of the nozzle blade 234 may face a turbine wheel and the outer surface 426 may face away from the turbine wheel. In general, the inner surface 428 of the nozzle blade 234 may experience a lower pressure compared to the outer surface 426. Thus, the outer surface 426 of the nozzle blade 234 may be referred to as a pressure surface of the nozzle blade while the inner surface 428 may be referred to as a suction side of the nozzle blade. A camber line 436 drawn through a mid-section of the nozzle blade 234 connects the leading edge 306 to the trailing edge 308 of the nozzle blade. The outer surface 426 of the nozzle blade 234 may be a curved outer surface having a concave portion and a convex portion, where the concave portion is formed adjacent to the leading edge 306 of the nozzle blade and the convex portion is formed between a mid-section and the trailing edge 308 of the nozzle blade. As an example, the concave portion of the outer surface 426 curves towards the camber line 436 of the nozzle blade 234, and the convex portion of the outer surface 426 curves away from the camber line 436. Conversely, the inner surface 428 of the nozzle blade 234 may be a curved inner surface having a convex portion formed adjacent to the leading edge 306 of the nozzle blade. The inner surface 428 may further comprise a concave portion formed between the mid-section and trailing edge 308 of the nozzle blade 234. As an example, the concave portion of the inner surface 428 may curve towards the camber line 436 of the nozzle blade 234, and the convex portion of the inner surface 428 may curve away from the camber line 436. The side surface 430 formed adjacent to the outer surface 426 and inner surface 428 of the nozzle blade 234 may form a cambered surface of the nozzle blade. During engine operation, exhaust gas flows from the leading edge 306 of the nozzle 234 blade to the trailing edge 308, before entering the turbine wheel (such as the turbine wheel 230 shown in FIG. 3A).

The nozzle blade 234 may be pivotally mounted to the nozzle plate (e.g., nozzle plate 404 shown in FIG. 4A) about a hinge axis 438 which crosses the camber line 436 at the pivot location 420. As an example, the nozzle blade 234 may be pivotally mounted to the nozzle plate, such that the nozzle blade is adjustable between an open and a closed position. During turbine operation, exhaust flow from the engine may impinge on the nozzle blade 234 along a direction shown by a first arrow 445. The exhaust flow may exit the nozzle blade 234 in a direction shown by a second arrow 446. The nozzle blade 234 may include a blade angle 448 formed between a horizontal axis 450 and a tangent line 452 to the camber line 436, where the horizontal axis 450 is normal to the side surface 430 and perpendicular to a vertical axis 454. The blade angle is defined relative to a meridional direction of the blade. The blade angle 448 may be measured at various locations along the camber line 436 in a similar manner as shown at the leading edge 306 of the nozzle blade 234. For example, the blade angle 448 may be measured at several locations along the camber line 436 including the pivot location 420, a first position 440, a second position 442 and a third position 444, at a particular open nozzle blade position. As an example, the first position 440 may be located at a normalized distance of 60% to 75% (along the chord length 456 of the nozzle blade) from an inlet at the leading edge 306 of the nozzle blade to an outlet at the trailing edge 308 of the nozzle blade. In a further example, the second position 442 may be located at a normalized distance of 80% to 95% from the inlet of the nozzle blade 234 to the outlet at the trailing edge 308 of the nozzle blade, and the third position 444 may be located at the trailing edge 308 of the blade.

The blade angle 448 along the camber line 436 of the nozzle blade 234 may change for each open position of the nozzle blade. A normalized difference in the blade angle 448, hereafter referred to as a camber line angle change ratio may be calculated at each point along the camber line 436 as a difference between a blade angle at a specific point on the camber line 436 and a blade angle at the leading edge 306 of the nozzle blade, the difference in the blade angle being normalized by the blade angle at the leading edge 306. The camber line angle change ratio of the nozzle blade 234 may be given by following equation:

$$\text{Camb_ratio}=(\text{Angle_}x-\text{Angle_inlet})/\text{Angle_inlet} \quad (1)$$

where Camb_ratio is the camber line angle change ratio, Angle_x is a blade angle at a specific location along the camber line 436 of the nozzle blade 234 and Angle_inlet is the blade angle at a leading edge 306 of the nozzle blade.

The chord length 456 of the nozzle blade 234 may be defined as a projected length between the leading edge 306 and trailing edge 308 of the nozzle blade. As an example, the chord length 456 of the nozzle blade 234 may have a first range of 29 mm-34 mm. In another example, the chord length 456 of the nozzle blade 234 may have a second range of 35 mm-45 mm. Further, nozzle blade 234 may have a height 458 and thickness 460 (which changes along the chord length 456). As an example, the height 458 of the nozzle blade 234 may range from 7 mm to 11 mm. The thickness 460 of the nozzle blade 234 may be greatest at a mid-stream of the nozzle blade, and may decrease gradually towards to the leading edge 306 and trailing edge 308 of the nozzle blade. As an example, the normalized thickness 460 of the nozzle blade 234 may range from 0.06 to 0.12, where the normalized thickness is defined by a ratio of maximum thickness to the rotor inlet radius. In this way, the nozzle blade 234 on the nozzle plate 404 may be designed with an appropriate combination of dimensions, thereby allowing the nozzle blade to be used for a wide range of exhaust flow conditions during engine operation. By providing a nozzle blade with an appropriate combination of aspect ratio, blade thickness and camber line angle change ratio, turbine efficiency may be improved and high cycle fatigue of turbine components may be reduced. During nominal turbine operation, especially at small nozzle open condition, the nozzle blade on the turbine nozzle having the geometries described herein allows for a reduced flow loss inside the turbine nozzle, thereby improving turbine stage efficiency for various engine drive cycles. During the engine exhaust braking condition, the optimized curvature of the nozzle blade controls the expansion process within the turbine nozzle to reduce the tendency of the turbine to produce shock wave while improving turbine high cycle fatigue.

Referring to FIG. 5A, a schematic 500 of a comparison between a first nozzle plate 504 of a first turbine nozzle having a plurality of first nozzle blades 512 and a second nozzle plate 506 of a second turbine nozzle having a plurality of second nozzle blades 514 is disclosed. Each of the first and second nozzle blades 512 and 514 on each of the first and second nozzle plates 504 and 506 are adjusted to an open position. Each of the first and second nozzle plates 504 and 506 include an inner edge 516. The first nozzle plate 504 has an outer edge 518 and the second nozzle plate 506 has an outer edge 517, the outer edge 518 at a greater distance from the inner edge 516 than the outer edge 517. Both the first and second nozzle plates 504 and 506 include a first axis 508 and a second axis 510.

As shown in FIG. 5A, the inner edge 516 of the first nozzle plate 504 and second nozzle plate 506 may have an inner radius 520. As an example, the inner radius 520 of the inner edge 516 of the first and second nozzle plates 504 and 506 may range from 30 mm to 45 mm. The outer edge 517 of the second nozzle plate 506 may have an outer radius 522, larger than the inner radius 520 of the inner edge 516. As an example, the outer radius 522 of the outer edge 517 of the second nozzle plate 506 may range from 50 mm to 70 mm. The outer edge 518 of the first nozzle plate 504 may have an outer radius 524, larger than the outer radius 522 of the outer edge 517 of the second nozzle plate 506. As an example, the outer radius 524 of the outer edge 518 of the first nozzle plate 504 may range from 55 mm to 75 mm.

Each first nozzle blade 512 may be pivotally mounted to the first nozzle plate 504 via a rod 515A extended through the nozzle plate 504 to adequately secure the nozzle blade to the nozzle plate 504. As an example, the first nozzle blade 512 may be pivotally mounted to the first nozzle plate 504 using the rod 515A positioned at a radial distance 525A in a range of 45 mm to 60 mm. Similarly, each second nozzle blade 514 may be pivotally mounted to the second nozzle plate 506 via a rod 515B extended through the second nozzle plate 506 to adequately secure the nozzle blade. The rod 515B may be positioned at a radial distance 525B that ranges from 48 mm to 65 mm. The first nozzle blade 512 may have a longer chord length compared to the second nozzle blade 514, hereafter referred to as a base blade design. Details on geometry of the first nozzle blade 512 are disclosed further below with reference to FIG. 5B.

Turning now to FIG. 5B, a cross sectional view 502 showing a plurality of first nozzle blades 512A, 512B and 512C is disclosed. For example, the first nozzle blade 512A includes an outer surface 530 and an inner surface 532. A camber line 525 drawn through a mid-section of the first nozzle blade 512A connects a leading edge 526A of the nozzle blade to a trailing edge 528A of the nozzle blade. The outer surface 530 of the first nozzle blade 512A may be a curved outer surface having an outer concave portion and convex portion. As an example, the outer concave portion of the outer surface 530 may be formed adjacent to the leading edge 526A, and the outer convex portion may be formed between a mid-section and the trailing edge 528A of the nozzle blade. In one example, the outer concave portion of the outer surface 530 curves towards the camber line 525 of the nozzle blade 512A, and the outer convex portion of the outer surface 530 curves away from the camber line 525. Conversely, the inner surface 532 of the first nozzle blade 512A may be a curved inner surface having an inner convex portion formed adjacent to the leading edge 526A. The inner surface 532 may further include an inner concave portion between the mid-section and trailing edge 528A of the nozzle blade. For example, the inner concave portion of the inner surface 532 curves towards the camber line 525 of the nozzle blade 512A, and the inner convex portion of the inner surface 532 curves away from the camber line 525.

The first nozzle blade 512A may have a chord length 534, which defines a projected (e.g., straight line) distance between the leading edge 526A and trailing edge 528A of the nozzle blade. As an example, the chord length 534 of the nozzle blade may range from 30 mm to 55 mm. An aspect ratio of the first blades 512A and 512B may be defined as a ratio between the chord length 534 and a gap 536 formed between trailing edges 528A and 528B of nozzle blades 512A and 512B, respectively, when the nozzle blades are adjusted to an open position. The aspect ratio may be given by the following equation:

$$AR_L = CL_L / BL_L \quad (2)$$

where $AR_L$ is the aspect ratio of the nozzle blades, $CL_L$ is the chord length of the nozzle blades and $BL_L$ is distance between the trailing edges 528A and 528B of the nozzle blades 512A and 512B, respectively. As an example, the aspect ratio of the nozzle blades may range from 2.15 to 2.6. By providing a wide range of blade aspect ratios, the variable nozzle turbine may be adapted to accommodate a wide range of exhaust flow conditions during engine operation.

Figure 6A:
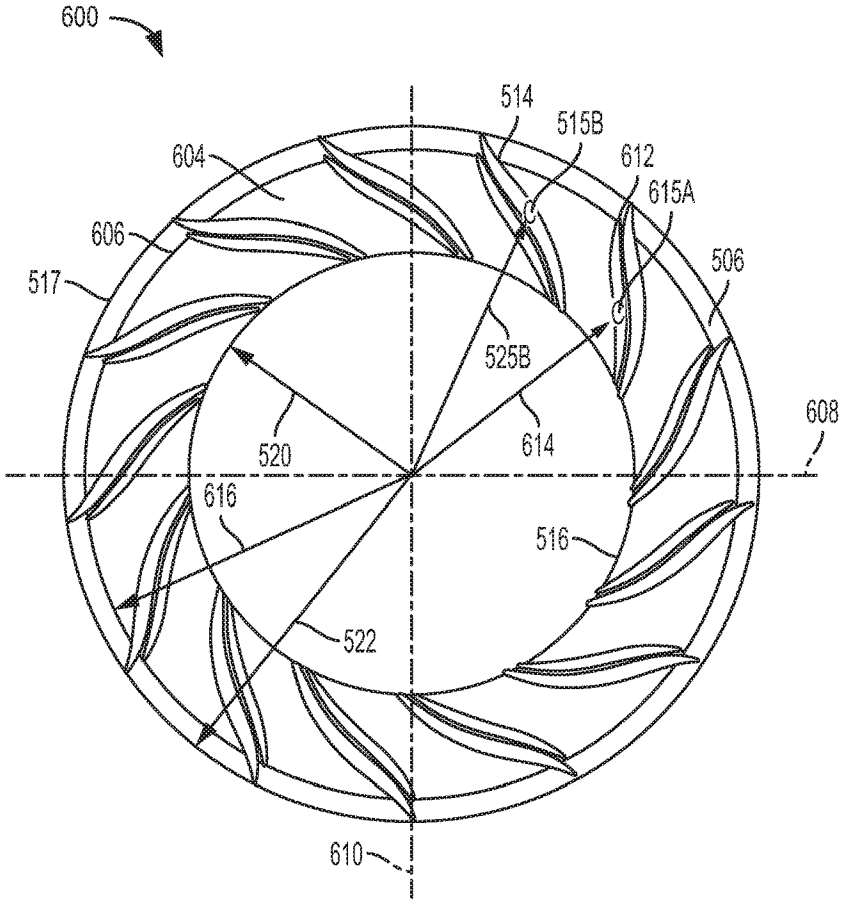
FIG. 6A shows a schematic view of the second nozzle plate having the plurality of second blades and a third nozzle plate having a plurality of third nozzle blades.
Figures 7A, 7B, 7C:
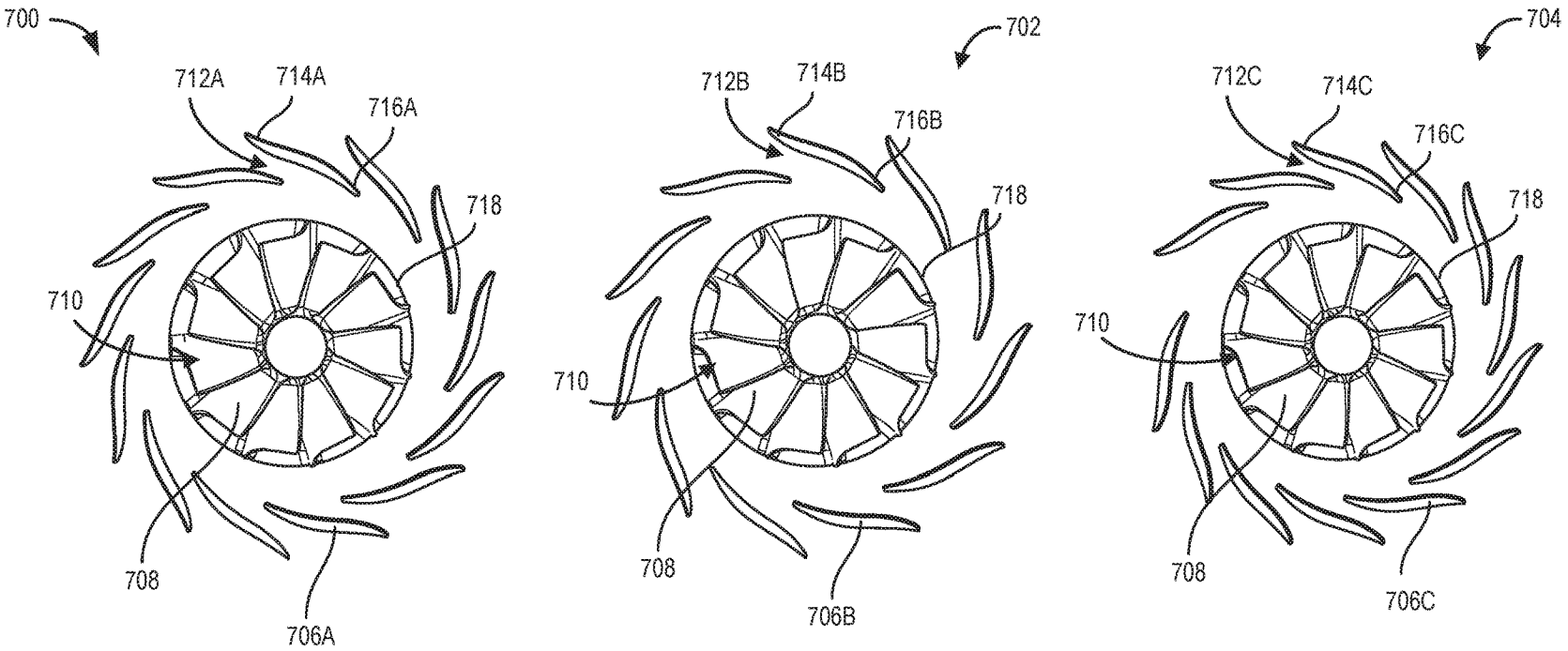
FIG. 7A shows a schematic view of a first number of nozzle blades adjusted to an open position around a periphery of a turbine wheel.
FIG. 7B shows a schematic view of a second number of nozzle blades adjusted to an open position around the periphery of the turbine wheel.
FIG. 7C shows a schematic view of a third number of nozzle blades adjusted to an open position around the periphery of the turbine wheel.

Referring to FIG. 6A, a schematic view 600 of a comparison between the second nozzle plate 506 of the second turbine nozzle having the plurality of second nozzle blades 514 and a third nozzle plate 604 of a third turbine nozzle having a plurality of third nozzle blades 612 is disclosed. Each of the second nozzle plate 506 and third nozzle plate 604 include the inner edge 516. The second nozzle plate 506 has the outer edge 517 and the third nozzle plate 604 has an outer edge 606, the outer edge 517 at a greater distance from the inner edge 516 than the outer edge 606. Both the second nozzle plate 506 and third nozzle plate 604 may include a first axis 608 and a second axis 610.

As shown in FIG. 6A, the inner edge 516 of the second nozzle plate 506 and third nozzle plate 604 may have the inner radius 520. As an example, the inner radius 520 of the inner edge 516 of the first nozzle plate 506 and second nozzle plate 604 may range from 30 mm to 45 mm. The outer edge 517 of the second nozzle plate 506 may have the outer radius 522, larger than the inner radius 520 of the inner edge 516. As an example, the outer radius 522 of the outer edge 517 of the second nozzle plate 506 may range from 55 mm to 75 mm. The outer edge 606 of the third nozzle plate 604 may have an outer radius 616, smaller than the outer radius 522 of the outer edge 517 of the second nozzle plate 506. As an example, the outer radius 616 of the outer edge 606 of the third nozzle plate 604 may range from 50 mm to 70 mm.

Each second nozzle blade 514 may be pivotally mounted to the second nozzle plate 506 via rod 515B extended through the second nozzle plate to secure the nozzle blade to the nozzle plate. The rod 515B may be positioned at the radial distance 525B that ranges from 45 mm to 60 mm. Similarly, each third nozzle blade 612 may be pivotally mounted to the third nozzle plate 604 via a rod 615A extended through the third nozzle plate 604 to secure the nozzle blade to the nozzle plate 604. The rod 615A on the third nozzle blade 612 may be positioned at a radial distance 614 that ranges from 48-65 mm. The third nozzle blade 612 may be a shorter blade design having a shorter chord length compared to the second nozzle blade 514, hereafter referred to as the base nozzle blade design. Details on geometry of the third nozzle blade 612 are disclosed further below with reference to FIG. 6B.

Turning now to FIG. 6B, a cross sectional view 602 showing the plurality of third nozzle blades 612A, 612B and 612C is disclosed. For example, the third blade 612A includes an outer surface 624 and an inner surface 626. A camber line 625 drawn through a mid-section of the nozzle blade 612A connects a leading edge 618A of the nozzle blade to a trailing edge 620A of the nozzle blade. The outer surface 624 of the third blade 612A may be a curved outer surface having an outer concave portion formed adjacent to the leading edge 620A of the nozzle blade. The outer surface 624 may further include an outer convex portion formed between a mid-section and the trailing edge 620A of the nozzle blade 612A. As an example, the outer concave portion of the outer surface 624 may curve towards the camber line 625 of the nozzle blade 612A, and the outer convex portion of the outer surface 624 may curve away from the camber line 625. Conversely, the inner surface 626 of the third nozzle blade 612A may be a curved inner surface having an inner convex portion formed adjacent to the leading edge 618A and an inner concave portion formed between a mid-section and trailing edge 620A of the blade. The inner concave portion of the inner surface 626 may curve towards the camber line 625 of the nozzle blade 612A, and the inner convex portion of the inner surface 626 may curve away from the camber line 625. The third nozzle blade 612A may have a chord length 628, which defines a projected distance (e.g., straight line) between the leading edge 618A and trailing edge 620A of the nozzle blade. As an example, the chord length 628 of nozzle blade may range 28.6 mm to 34 mm. Each of the second and third nozzle blades 612B and 612C have the same geometry as the first nozzle blade 612A.

An aspect ratio of the third blades 612A-612B may be defined as a ratio between the chord length 628 and a gap 630 formed between trailing edges 620A and 620B of nozzle blades 612A and 612B, respectively, when the blades are adjusted to an open position. The aspect ratio of the nozzle blades 612A and 612B may be given by the following equation:

$$AR_S = CL_S / BL_S \quad (3)$$

where $AR_S$ is the aspect ratio of the nozzle blades, $CL_S$ is the chord length of the nozzle blades and $BL_S$ is distance between the trailing edges 620A and 620B of the nozzle blades 612A and 612B, respectively. As an example, the aspect ratio of the nozzle blades 612A and 612B may range from 1.6 to 2.2. In this way, each pair of nozzle blades 612A and 612B may have a wide range of aspect ratios when the nozzle blades are adjusted through a plurality of open positions. By providing a wide range of blades aspect ratios, the variable nozzle turbine may be adjusted to accommodate a wide range of exhaust flow conditions while improving turbine efficiency and minimizing fatigue of turbine components.

The aspect ratio of nozzle blades provided on a nozzle plate of a variable nozzle turbine may range from 1.6 to 2.2, for example. In another example, the aspect ratio of the nozzle blades on the nozzle plate may range from 1.84 to 2.26. In a further example, the aspect ratio of the nozzle blades on the nozzle plate may range from 1.54 to 2.56. As an example, the aspect ratio may increase with an increase in the chord length of the nozzle blades provided on the nozzle plate. In another example, the aspect ratio may increase with an increase in a number of nozzle blades provided on the nozzle plate. In this way, a nozzle blade design with an appropriate combination of aspect ratio, blade thickness and camber line angle change ratio may be provided on a nozzle plate of a variable nozzle turbine to improve turbine efficiency and reduce high cycle fatigue of turbine components.

Referring to FIGS. 7A, 7B and 7C, schematic views 700, 702 and 704 showing a plurality of nozzle blades 706A, 706B and 706C, respectively, adjusted to open positions around a periphery of a turbine wheel 708 are disclosed. Schematic view 700 shows a first number of nozzle blades 706A adjusted to an open position around the periphery of the turbine wheel 708 having a plurality of turbine blades 710. Schematic view 702 shows a second number of nozzle blades 706B adjusted to an open position around the periphery of the turbine wheel 708. Schematic view 704 shows a third number of nozzle blades 706C adjusted to an open position around the periphery of the turbine wheel 708. Although not shown, a first nozzle plate, a second nozzle plate and a third nozzle plate may be provided to accommodate the nozzle blades 706A, 706B and 706C, respectively, surrounding the turbine wheel 708 in each view 700, 702 and 704. Each nozzle blade 706A, 706B and 706C may be mounted to the each of the first, second and third nozzle plates via a rod that allows the nozzle blade to be adjustable between the open position and a closed position.

Each of the nozzle blades 706A, 706B and 706C may be adjusted to the open position, where a size of openings 712A, 712B and 712C between each pair of nozzle blades (shown in FIGS. 7A, 7B and 7C, respectively) may be adjustable to direct radial exhaust flow into the turbine blades 710 on the turbine wheel 708 based on engine operating conditions. In this case, each nozzle blade 706A, 706B and 706C may be pivoted about a mounting axis such that each leading edge 714A, 714B and 714C of each nozzle blade 706A, 706B and 706C faces away from the turbine wheel 708 and each trailing edge 716A, 716B and 716C of each nozzle blade 706A, 706B and 706C faces an outer circumferential surface 718 of the turbine wheel 708. In this example, exhaust flow enters the turbine wheel 708 at a suitable angle that allows the turbine wheel 708 to rotate about a fixed axis, the rotational motion of the turbine wheel driving a compressor (not shown) coupled to the turbine. The compressor allows engine boost pressure to be adjusted based on engine operating conditions. For example, when the nozzle blades 706A, 706B and 706C are adjusted to the open position, less energy may be imparted to the turbine which in turn decreases compressor output to reduce compressor boost. The degree of nozzle blade opening may be adjustable to accommodate various exhaust flow conditions based on engine operating conditions. As an example, during moderate to high engine speed and load, the nozzle blades 706A, 706B and 706C may be adjusted to a fully open position to reduce turbocharger over-speed while maintaining adequate engine boost pressure.

In another example, the nozzle blades 706A, 706B and 706C may be adjusted from the fully open position to a closed position, where the leading edge of a first nozzle blade may be positioned adjacent to the trailing edge of a second nozzle blade, thereby reducing the size of the opening in between the nozzle blades to reduce exhaust flow through the nozzle blades. In case, the nozzle blades 706A, 706B and 706C may be adjusted to the closed position to direct exhaust flow tangentially to the nozzle blades. In this example, exhaust flow imparts more energy to the turbine which in turn may increase compressor output to improve engine boost pressure based on engine operating conditions. In another example, during low engine speed/load and low exhaust flow, the nozzle blades 706A, 706B and 706C may be adjusted to the closed position to increase turbine power and improve engine boost pressure.

A number of nozzle blades 706A, 706B and 706C mounted to the first, second and third nozzle plates (each nozzle plate positioned concentrically with the turbine wheel 708) may be adjusted based on the radius and to reduce or suppress shock vibration in the turbine. For example, a number of nozzle blades 706A provided on the first nozzle plate enclosing the turbine 708 may range from 11 to 14. In one example, the aspect ratio of the nozzle blades 706A may range from 1.74 to 2.4. In another example, the number of nozzle blades 706B provided on the second nozzle plate that encloses the turbine 708 may be 13. In this case, the aspect ratio of the nozzle blades 706B may range from 2.05 to 2.65. In a further example, the number nozzle blades 706C provided on the third nozzle plate that encloses the turbine 708 may be 14. In this example, the aspect ratio of the nozzle blades 706C may range from 2.20 to 2.95. In this way, the number of nozzle blades 706A, 706B and 706C on the first, second and third nozzle plates, respectively, may be varied to accommodate a wide range of exhaust flow conditions based on engine operating conditions.

The aspect ratio of nozzle blades on a nozzle plate may increase with increase in the number of nozzle blades provided on the nozzle plate. For example, increasing the number of nozzle blades from 11 to 14 increases the aspect ratio from 1.74 to 2.2. By increasing the number of nozzle blades on the nozzle plate, the aspect ratio may change from a first value to a second value. In this way, an appropriate number of nozzle blades may be provided on a nozzle plate to achieve a suitable aspect ratio that increases turbine efficiency.

Referring to FIG. 8, an example graphic output 800 of normalized thickness distribution for various nozzle blade designs is disclosed. The normalized thickness for each nozzle blade design varies with a normalized distance along a chord length of the nozzle blade design. The horizontal axis represents the normalized distance along the chord length of a thicker, a base and a thinner blade design, and the normalized distance increases in a direction of the horizontal axis. An inlet on each of the thicker, base and thinner nozzle blade designs is positioned at a leading edge (e.g., leading edge 302 shown in FIG. 4A) located at a normalized distance of 0% along the chord length of each blade design between the inlet and an outlet of each blade design. The outlet on each of the thicker, base and thinner nozzle blade designs is located at a trailing edge (e.g., trailing edge 308 shown in FIG. 4A) located at a normalized distance of 100% along the chord length of each blade design between the inlet and outlet. The vertical axis represents the normalized thickness distributions for each of the thicker, base and thinner nozzle blade designs, and the normalized thickness distributions increases in a direction of the vertical axis. Trace 802 represents a normalized thickness versus the normalized distance along the chord length of the thicker nozzle blade design, between the inlet and outlet of the thicker blade. Trace 804 represents a normalized thickness versus the normalized distance along the chord length of the base nozzle blade design, between the inlet and outlet of the base blade. Trace 806 represents a normalized thickness versus a normalized distance along the chord length of a thinner nozzle blade design, between the inlet and outlet of the thicker blade.

For each of the thicker, base and thinner nozzle blade designs, each normalized thickness 802, 804, and 806 gradually increases from a minimum value at the blade inlet to a maximum value at a mid-section of each nozzle blade design. A rate of increase in the normalized thickness 802 of the thicker nozzle blade design may be greater than a rate of increase in the normalized thickness 804 and 806 of the base and thinner nozzle blade designs, respectively. In this example, the rate of increase in the normalized thickness 804 of the base nozzle blade design may be greater than the rate of increase in the normalized thickness 806 of thinner nozzle blade design. The maximum normalized thickness at the mid-stream of each of the thicker, base and thinner nozzle blade designs may be located at a normalized distance of 53% along the chord length of each blade design between the blade inlet and outlet. In another examples, the maximum normalized thickness of each of the thicker, base and thinner nozzle blade designs may be located at a normalized distance that ranges from 45% to 61% along the chord length of each blade design between the blade inlet and outlet. In a further example, the maximum normalized thickness of each of the thicker, base and thinner nozzle blade designs may be located at a normalized distance that ranges from 45% to 53% along the chord length of each blade design between the blade inlet and outlet. In other examples, the normalized thickness of each of the thicker, base and thinner blade designs may be greatest in a range of 47 to 59% of the chord length. In alternative examples, the thickness of each of the thicker, base and thinner blade designs may have a minimum thickness at the inlet and outlet ends of the nozzle blade, and a maximum thickness in a range of 45% to 61% of the chord length.

A ratio of the maximum thickness (of each of the thicker, base and thinner nozzle blade designs) to a chord length of each nozzle blade design may be 0.093, for example. In another example, the ratio of the maximum thickness of each of the thicker, base and thinner nozzle blade designs to a chord length of each nozzle blade may range from 0.08 to 0.11. In a further example, the maximum thickness of the thicker nozzle blade design may be greater than the maximum thickness of the base and thinner nozzle blade designs, respectively. In another example, the maximum thickness of the base nozzle blade design may be greater than the maximum thickness of the thinner nozzle blade design.

After reaching a peak at the mid-stream of each of the thicker, base and thinner nozzle blade designs, the normalized thickness distribution 802, 804 and 806 may gradually decrease from the maximum normalized thickness to a minimum normalized thickness at the outlet of each nozzle blade design. As an example, a rate of decrease in the normalized thickness 802 of the thicker nozzle blade design may be greater than a rate of decrease in the normalized thickness 804 and 806 of the base and thinner nozzle blade designs, respectively. In a further example, the rate of decrease in the normalized thickness 804 of the base nozzle blade design may be greater than the rate of decrease in the normalized thickness 806 of thinner nozzle blade design.

In this way, a nozzle blade may have a normalized thickness that increases gradually from a blade inlet at a leading edge of the blade and peaks at a mid-section of the blade before gradually decreasing to a minimum normalized thickness at an outlet located at the trailing edge of the nozzle blade. The maximum normalized thickness of the nozzle blade may be increased by increasing the size of the nozzle blade. By varying the distribution of the normalized thickness, the nozzle blade may be designed to direct exhaust flow into the turbine nozzle while improving turbine efficiency and minimizing fatigue of turbine components. The distribution in the normalized thickness and the variation in the blade angle together affect the expansion process inside the turbine nozzle. In this example, the distribution of the normalized thickness of the nozzle blade allows for low flow loss and weakened shock at the exhaust braking condition, thereby improving turbine efficiency and reducing turbine high cycle fatigue in the turbocharger.

Referring to FIG. 9, an example graphic output 900 of a camber line angle change ratio versus normalized distance along a chord length of a nozzle blade between at an inlet at the leading edge and an outlet at the trailing edge of the nozzle blade is disclosed. In this example, the nozzle blade may be adjusted to a large open position that allows a desired exhaust flow through nozzle blades on a nozzle plate of the variable nozzle turbine based on engine operating conditions. The vertical axis represents camber line angle change ratio and the camber line angle change ratio increases in the direction of the vertical axis. The horizontal axis represents normalized distance along a chord length of the nozzle blade, and the normalized distance along the chord length increases in the direction of the horizontal axis. Trace 902 represents the camber line angle change ratio versus the normalized distance along the chord length of the nozzle blade. The camber line angle change ratio is determined as a difference between a blade angle at a specific point along the camber line and a blade angle at a leading edge of the blade, the difference in the blade angle being normalized by the blade angle at the blade leading edge, as disclosed in Equation (1) above.

As shown in FIG. 9, the camber line angle change ratio 902 increases rapidly from a minimum value at the blade inlet to a maximum value 904 at a mid-section of the nozzle blade. For example, the maximum value 904 of the camber line angle change ratio 902 may be located at a normalized distance of 53% along the chord length between the blade inlet and outlet. The maximum value 904 may be located at a pivot location along the chord length of the nozzle blade, such as the pivot location 420 shown in FIG. 4B. In another example, the maximum value 904 of the camber line angle change ratio 902 may be located at a normalized distance that ranges from 45% to 65% along the chord length between the blade inlet and outlet.

After reaching the maximum value 904 near the middle streamwise position of the nozzle blade, the camber line angle change ratio 902 may gradually decrease to a first value 906 at a normalized distance that ranges from 60% to 75% along the chord length between the blade inlet and outlet. The first value 906 may be located at a first location along the chord length of the nozzle blade, such as the first location 440 shown in FIG. 4B. The camber line angle change ratio 902 may decrease further from the first value 906 to a second value 908, located at a normalized distance in a range of 80% to 95% from the blade inlet. The second value 908 may be located at a second location along the chord length of the nozzle blade, such as the second location 442 shown in FIG. 4B. The camber line angle change ratio 902 may increase from the second value 908 to a third value 910 at the trailing edge of the nozzle blade. The third value 906 may be located at a third location along the chord length of the nozzle blade, such as the third location 444 at the trailing edge 308 of the nozzle blade, shown in FIG. 4B. As an example, the camber line angle change ratio may be in a range of 0.94 to 1.16 from the inlet at the leading edge of the nozzle blade to the outlet at the trailing edge of the nozzle blade. In another example, the camber line angle change ratio may increase from the inlet end to a normalized distance of about 53% of the chord length, then decreases until about 90% of the chord length, and then increases again to the outlet end. In this way, the camber line angle change ratio 902 may change along the chord length of the nozzle blade, for a particular open blade position.

Referring to FIG. 10A, a cross sectional view 1000 showing a portion of a variable nozzle turbine is disclosed. The portion of variable nozzle turbine may include an inlet portion 1004 that directs exhaust flow from the engine into a turbine chamber 1008 via a nozzle 1002 and then a rotor portion 1006 that includes a first wall 1009 and a second wall 1010. The turbine chamber 1008 may be sized to accommodate a nozzle plate having a plurality of nozzle blades, and a turbine wheel mounted axially with the nozzle plate.

As shown in FIG. 10A, a side wall 1012 of the turbine chamber 1008 may be formed at angle 1014 to an intersecting line 1016. The sidewall 1012 of the turbine chamber may connect to the first wall 1009 of the rotor portion 1006, forming a single continuous external wall of the turbine. The angle 1014 may be adequately sized to allow for uninterrupted flow of exhaust gas into the turbine chamber 1008, for example. In one example, the angle 1014 may range from 3-10 degrees. The rotor portion 1006 may have a rotor inlet radius 1018. As an example, the rotor inlet radius 1018 may be selected to allow adequate exhaust flow into the turbine chamber 1008. In one example, the rotor inlet radius 1018 may range from 30 mm to 40 mm. The exhaust flow exists the turbine chamber 1008 at an outlet, as shown by direction arrow 1020.

Turning now to FIG. 10B, an example graphic output 1022 of a nozzle blade (e.g., vane) height, a rotor inlet radius of a variable nozzle turbine and ratio of nozzle blade height to rotor inlet radius is disclosed. The ratio of nozzle blade height to rotor inlet radius is calculated by dividing the nozzle blade height with a plurality of rotor inlet radii of a turbine.

The first nozzle blade height is greater than the second nozzle blade height. The plurality of rotor inlet radii of the variable nozzle turbine include a first, a second and third rotor inlet radii. The first rotor inlet radii is lower than the second and third rotor inlet radii, and the second rotor inlet radii is lower than the third inlet radii. For each of the first and second nozzle blade heights, the ratio of nozzle blade height to rotor inlet radius decreases with increase in the rotor inlet radius. As an example, the ratio of nozzle blade height to rotor inlet radius may decrease from 0.226 to 0.206 for the first nozzle blade height of 0.007 m. In another example, the ratio of nozzle blade height to rotor inlet radius may decrease from 0.355 to 0.324 for the second nozzle blade height of 0.011 m.

When the nozzle blade height is increased from the first nozzle blade height to the second nozzle blade height, the ratio of nozzle blade height to rotor inlet radius increases from a first value to a second value for a fixed rotor inlet radius. As an example, when the nozzle blade height is increased from 0.007 m to 0.011 m, the ratio of nozzle blade height to rotor inlet radius increases from 0.226 to 0.355 for a rotor inlet radius of 0.0310. In this way, the ratio of nozzle blade height to rotor inlet radius may be increased by increasing nozzle blade height. In further examples, other dimensions for the nozzle blade height and rotor inlet radius may be provided to achieve an appropriate range for the ratio of nozzle blade height to rotor inlet radius. In this way, a nozzle blade design with a combination of aspect ratio, blade thickness and camber line angle change ratio in specified ranges, as disclosed herein, may be provided on a nozzle plate of a variable nozzle turbine having a wide range of rotor inlet radii to improve turbine efficiency and reduce high cycle fatigue of turbine components. Specifically, nozzle blades having a geometry with an aspect ratio and thickness in the ranges disclosed herein may result in increased turbine efficiency and reduced high cycle fatigue of turbine components when compared to nozzle blades having a geometry with an aspect ratio and thickness outside the ranges disclosed herein, or only one of these geometry characteristics. In another embodiment, nozzle blades having a geometry with each of an aspect ratio, thickness, and camber line change ratio in the ranges disclosed herein may result in increased turbine efficiency and reduced high cycle fatigue of turbine components compared to nozzle blades not having this combination of geometry features.

In one example, a nozzle blade for a turbine nozzle of a variable geometry turbine may comprises: a cambered outer surface that curves from an inlet end (e.g., leading edge) to an outlet end (e.g., trailing edge) of the nozzle blade, relative to a chord of the nozzle blade, the chord having a chord length defined from the inlet end to the outlet end, the nozzle blade having an aspect ratio in a range of 1.54 to 2.56, a thickness that is greatest in a range of 47 to 61% of the chord length. In the preceding example, the nozzle blade has a camber line angle change ratio in a range of 0.94 to 1.16 from the inlet end to a peak blade angle of the nozzle blade. In any or all of the preceding examples, additionally or optionally, the camber line angle change ratio increases from the inlet end to about 53% of the chord length, then decreases until about 90% of the chord length, and then increases again to the outlet end.

Furthermore, in any or all of the preceding examples, additionally or optionally, the chord length ranges from 29 mm to 40 mm. In any or all of the preceding examples, additionally or optionally, a pivot axis of the nozzle blade is positioned at location in a range of 30-50% of the chord length from the inlet end to the outlet end of the nozzle blade. In any or all of the preceding examples, additionally or optionally, a rate of change of the camber line angle change ratio is greatest between the inlet end of the nozzle blade and a mid-section of the blade along the chord length. In any or all of the preceding examples, additionally or optionally, the aspect ratio increases as the chord length increases. In any or all of the preceding examples, additionally or optionally, the outlet end of the nozzle blade is positioned closer to a turbine wheel of the variable geometry turbine than the inlet end of the nozzle blade.

In any or all of the preceding examples, additionally or optionally, the thickness of the nozzle blade has a minimum thickness at the inlet and outlet ends of the nozzle blade, and a maximum thickness in a range of 50% to 55% of the chord length. In any or all of the preceding examples, additionally or optionally, a ratio of the maximum thickness of the nozzle blade to the chord length of the nozzle blade is in a range of 0.08 to 0.11. In any or all of the preceding examples, additionally or optionally, the nozzle blade has a height ranging from 7.0 mm to 11 mm.

In another example, a turbine nozzle may comprise: a nozzle wall plate; and a nozzle blade adapted to pivot on the nozzle wall plate, the nozzle blade having: a camber line curving from a leading edge to a trailing edge of the nozzle blade and a chord length defined from the leading edge to the trailing edge, where a camber line angle change ratio of the nozzle blade is greatest in a range of 47.7 to 58.3% of the chord length, a thickness that is greatest in a range of 47.7 to 58.3% of the chord length, and an aspect ratio of the nozzle blade in a range of 1.54 to 2.56. In any or all of the preceding examples, additionally or optionally, a pivot axis of the nozzle blade is positioned at a location in a range of 30-50% of the chord length from the inlet end of the nozzle blade.

In any or all of the preceding examples, additionally or optionally, the nozzle blade is pivotally adjustable between an open position and a closed position about the pivot axis. In any or all of the preceding examples, additionally or optionally, the thickness of the nozzle blade has a distribution having a minimum value at the leading edge and trailing edge of the nozzle blade, and a maximum value at a normalized distance in a range of 50%-55% of the chord length.

An example turbine assembly may comprise: a rotor having a rotor inlet radius; a turbine wheel; and a turbine nozzle surrounding the turbine wheel and including a plurality of nozzle blades, the nozzle blades coupled to a nozzle wall plate of the turbine nozzle, each nozzle blade of the turbine nozzle comprising: an aspect ratio that increases with a number of nozzle blades on the nozzle wall plate; a thickness distribution that has a maximum value in a range of 47 to 59% of a chord length of the nozzle blade; and a nozzle blade height in a range of 7 mm to 11 mm. In any or all of the preceding examples, additionally or optionally, the aspect ratio is in a range of 1.74 to 2.20 and the number of the plurality of nozzle blades is in a range of 11 to 14. In any or all of the preceding examples, additionally or optionally, a ratio of the nozzle blade height to the rotor inlet radius is in a range of 0.17 to 0.37.

FIGS. 2A-7C show example configurations with relative positioning of the various components of the variable nozzle turbine of the turbocharger. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A nozzle blade for a turbine nozzle of a variable geometry turbine, comprising:

a cambered outer surface that curves from an inlet end to an outlet end of the nozzle blade, relative to a chord of the nozzle blade, the chord having a chord length defined from the inlet end to the outlet end, the nozzle blade having an aspect ratio in a range of 1.54 to 2.95, a thickness that is greatest in a range of 47% to 61% of the chord length.

2. The nozzle blade of claim 1, wherein the nozzle blade has a camber line angle change ratio in a range of 0.94 to 1.16 from the inlet end to a peak blade angle of the nozzle blade.

3. The nozzle blade of claim 2, wherein the camber line angle change ratio increases from the inlet end to a normalized distance of about 53% of the chord length, then decreases until about 90% of the chord length, and then increases again to the outlet end.

4. The nozzle blade of claim 1, wherein a pivot axis of the nozzle blade is positioned at a location in a range of 30% to 50% of the chord length from the inlet end to the outlet end of the nozzle blade.

5. The nozzle blade of claim 1, wherein a rate of change of the camber line angle change ratio is greatest between the inlet end of the nozzle blade and a mid-section of the blade along the chord length.

6. The nozzle blade of claim 1, wherein the aspect ratio increases as the chord length increases.

7. The nozzle blade of claim 1, wherein the outlet end of the nozzle blade is positioned closer to a turbine wheel of the variable geometry turbine than the inlet end of the nozzle blade.

8. The nozzle blade of claim 1, wherein the thickness of the nozzle blade has a minimum thickness at the inlet and outlet ends of the nozzle blade, and a maximum thickness in a range of 50% to 55% of the chord length.

9. The nozzle blade of claim 8, wherein a ratio of the maximum thickness of the nozzle blade to the chord length of the nozzle blade is in a range of 0.08 to 0.11.

10. The nozzle blade of claim 1, wherein the chord length ranges from 28 mm to 55 mm.

11. The nozzle blade of claim 1, wherein the nozzle blade has a height ranging from 7.0 mm to 11 mm.

12. A turbine nozzle, comprising:

a nozzle wall plate; and a nozzle blade adapted to pivot on the nozzle wall plate, the nozzle blade having:

a camber line curving from a leading edge to a trailing edge of the nozzle blade and a chord length defined from the leading edge to the trailing edge, where a camber line angle change ratio of the nozzle blade is greatest in a range of 47.7 to 58.3% of the chord length, a thickness that is greatest in a range of 47.7 to 58.3% of the chord length, and an aspect ratio of the nozzle blade in a range of 1.54 to 2.56.

13. The turbine nozzle of claim 12, wherein a pivot axis of the nozzle blade is positioned at a location in a range of 30-50% of the chord length.

14. The turbine nozzle of claim 13, wherein the nozzle blade is pivotally adjustable between an open position and a closed position about the pivot axis.

15. The turbine nozzle of claim 12, wherein the chord length ranges from 29 mm to 40 mm.

16. The turbine nozzle of claim 12, wherein the aspect ratio of the nozzle blade is higher as the chord length increases.

17. The turbine nozzle of claim 12, wherein the thickness of the nozzle blade has a distribution having a minimum value at the leading edge and trailing edge of the nozzle blade, and a maximum value at a normalized distance in a range of 50%-55% of the chord length.

18. A turbine assembly, comprising:

a rotor having a rotor inlet radius; turbine wheel; and a turbine nozzle surrounding the turbine wheel and including a plurality of nozzle blades, the nozzle blades coupled to a nozzle wall plate of the turbine nozzle, each nozzle blade of the turbine nozzle comprising:

an aspect ratio that increases as a number of the plurality of nozzle blades increases;

a thickness distribution that has a maximum value in a range of 47 to 61% of a chord length of the nozzle blade; and a nozzle blade height in a range of 7 mm to 11 mm.

19. The turbine assembly of claim 18, wherein the aspect ratio is in a range of 1.74 to 2.20 and the number of the plurality of nozzle blades is in a range of 11 to 14.

20. The turbine assembly of claim 18, wherein a ratio of the nozzle blade height to the rotor inlet radius is in a range of 0.175 to 0.37.

* * * * *